US010763611B2

(12) United States Patent
Toda

(10) Patent No.: US 10,763,611 B2
(45) Date of Patent: Sep. 1, 2020

(54) CONNECTOR WITH REDUCED COMPONENTS

(71) Applicant: J.S.T. Mfg. Co., Ltd., Osaka-shi, Osaka (JP)

(72) Inventor: Kenichi Toda, Yokohama (JP)

(73) Assignee: J.S.T. MFG. CO., LTD., Osaka-shi (JP)

( * ) Notice: Subject to any disclaimer, the term of this patent is extended or adjusted under 35 U.S.C. 154(b) by 62 days.

(21) Appl. No.: 15/487,902

(22) Filed: Apr. 14, 2017

(65) Prior Publication Data

US 2017/0346213 A1 Nov. 30, 2017

(30) Foreign Application Priority Data

May 31, 2016 (JP) ..... 2016-109146

(51) Int. Cl.

| | |
|---|---|
| ***H01R 13/504*** | (2006.01) |
| ***H01R 13/52*** | (2006.01) |
| ***H01R 24/64*** | (2011.01) |
| ***H01R 24/60*** | (2011.01) |
| *H01R 107/00* | (2006.01) |

(52) U.S. Cl.

CPC ..... *H01R 13/504* (2013.01); *H01R 13/5216* (2013.01); *H01R 24/64* (2013.01); *H01R 24/60* (2013.01); *H01R 2107/00* (2013.01)

(58) Field of Classification Search

CPC .. H01R 13/504; H01R 24/64; H01R 2107/00; B29C 70/72; B29C 70/84; B29C 70/845

USPC ..... 439/599, 686, 695, 701, 712, 724, 736, 439/676, 265, 722; 403/265; 264/272.13

See application file for complete search history.

(56) References Cited

U.S. PATENT DOCUMENTS 5,964,622 A * 10/1999 Ishikawa ..... B29C 45/1671 439/606
9,525,251 B2 * 12/2016 Yen ..... H01R 24/60
9,742,098 B2 * 8/2017 Zhao ..... H01R 13/5202

(Continued)

FOREIGN PATENT DOCUMENTS

CN 201838725 U 5/2011
JP 2014-107122 A1 6/2014

(Continued)

OTHER PUBLICATIONS

Office Action of Japanese Patent Application No. 2016-109146 dated Sep. 24, 2019 (4 sheets).

(Continued)

*Primary Examiner* — Renee S Luebke
*Assistant Examiner* — Paul D Baillargeon
(74) *Attorney, Agent, or Firm* — Kratz, Quintos & Hanson, LLP

(57) ABSTRACT

The connector includes: at least one contact; a housing to which the contact is arranged; a shell formed into a cylindrical shape inside of which the housing is disposed; and a joining member formed of a resin material; wherein the housing and the contact form an integral unit by means of the joining member, and the joining member is closely fitted within an inner surface of the shell or the joining member is integrally coupled to the inner surface of the shell. Thus, the number of components of the connector can be reduced but the manufacturing flexibility thereof can be increased and the connector can be easily miniaturized and manufactured.

6 Claims, 24 Drawing Sheets

(56) References Cited

U.S. PATENT DOCUMENTS

| | | | | |
|---|---|---|---|---|
| 9,991,625 | B2 | 6/2018 | Ozaki | |
| 2006/0001192 | A1* | 1/2006 | Oohashi | B29C 45/14639 264/279 |
| 2017/0155208 | A1* | 6/2017 | Zhang | H01R 13/5216 |

FOREIGN PATENT DOCUMENTS

| | | | |
|---|---|---|---|
| JP | 2015-5383 | A | 1/2015 |
| JP | 2015-111524 | A | 6/2015 |
| JP | 2015-125966 | A | 7/2015 |
| JP | 2015-212998 | A | 11/2015 |
| KR | 10-1355581 | B1 | 1/2014 |

OTHER PUBLICATIONS

Office Action of corresponding Chinese Patent Application No. 201710385199.8 dated Dec. 10, 2019 (5 sheets).

* cited by examiner 20
22
24
26
28
30
32
34
36
38
40
42

FIG. 18A
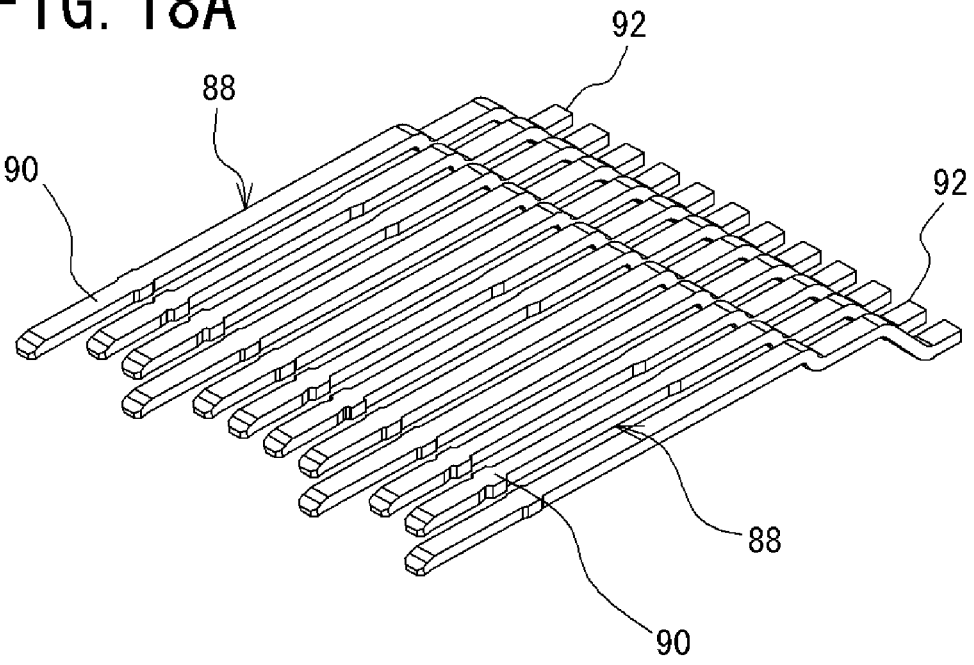
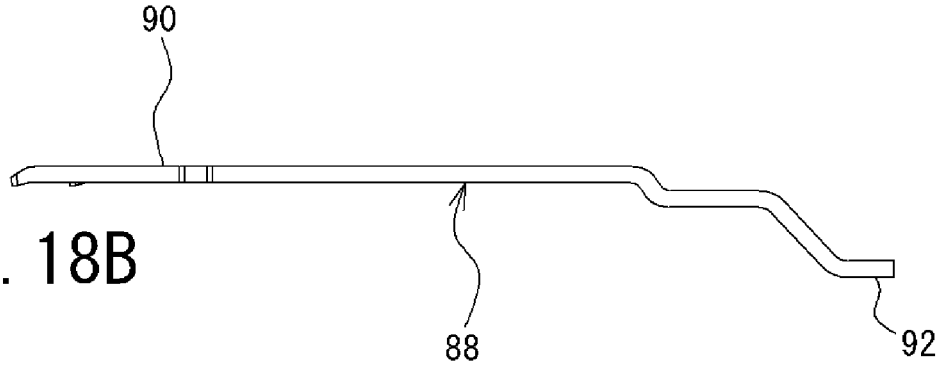
FIG. 18B

CONNECTOR WITH REDUCED COMPONENTS

TECHNICAL FIELD

This invention relates to a connector having a waterproof capability, more specifically, the present invention further relates to a connector in which the number of components can be reduced and which can be easily miniaturized and assembled.

BACKGROUND ART

Sealing members such as O-ring have been used heretofore for connectors in order to have a waterproof capability. For example, published unexamined patent application JP2014-107122 A discloses a connector including a housing forming a main body for supporting contacts and a seal member for providing a waterproof function at the perimeter direction of the main body wherein the seal member includes a base which adheres to the main body along the perimeter direction thereof and at least two strips of seal pieces and wherein when the connector is inserted into a hole to be inserted, the seal pieces abut against and fall down to the internal surface of the hole and an under side surface of the seal piece at the inserting port side come to be overlapped over an upper surface of another seal piece at the opposite side of the inserting port side.

According to the connector disclosed in the published unexamined patent application JP2014-107122 A, since the seal has seal pieces which outwardly expand therefrom, therefore, the space between the connector and the corresponding hole into which the connector is inserted and which is formed on a side wall or a cover of a housing of a device can be filled with the seal pieces regardless the case in which the space is large, the case in which the space is small, or the case in which the space is not even, thus the water proof capability can be obtained.

SUMMARY

In the case that a sealing member such as an O-ring is employed for obtaining a water proof capability as exemplified in the connector disclosed in the published unexamined patent application JP2014-107122 A, a number of components thereof can be increased, thus the assembling steps thereof and the manufacturing cost thereof can be increased. Further, in the case that the sealing member is employed, the surface to which the sealing member touches needs to be a smooth surface in order for obtaining a water proof capability, thus the flexibility in the design thereof can be limited.

This invention aims to solve the such problems of the prior art, and aims to provide a connector in which the number of components thereof can be reduced and which can be easily miniaturized and assembled.

In order to achieve the above purpose of the invention, a connector according to the first aspect of the present invention includes: at least one contact; a housing to which the contact is arranged; a shell formed into a cylindrical shape inside of which the housing is disposed; and a joining member formed of a resin material; wherein the housing and the contact form an integral unit by means of the joining member, and the joining member is closely fitted within an inner surface of the shell.

The second aspect of the present invention relates to a connector in the first aspect of the invention, wherein the joining member is fixed to the inner surface of the shell so that the joining member and the shell form an integral unit.

The third aspect of the present invention relates to a connector in the first aspect of the invention, wherein the housing is formed of a resin material, and the housing and the contact are formed so that the housing and the contact form an integral unit.

The fourth aspect of the present invention relates to a connector in the first aspect of the invention, wherein the housing includes at least two partial members being assembled together, and wherein the partial members form an integral unit by means of the joining member.

The fifth aspect of the present invention relates to a connector in the first aspect of the invention, wherein the resin material which forms the joining member has adhesiveness when the resin material is heat treated.

The sixth aspect of the present invention relates to a connector in the fifth aspect of the invention, wherein the joining member is formed of a resin material which melting point is different from the melting point of a resin material which forms the housing, and wherein the melting point of the resin material which forms the joining member is lower than the melting point of the resin material which forms the housing.

A manufacturing method for a connector according to one aspect of the present invention in which connector a housing and a contact are arranged inside a cylindrical shell, the method includes: forming one integral unit by molding the housing and the contact with a joining member which is formed of a resin material; and arranging the housing and the contact which are integrally formed by the joining member inside the shell so that the joining member is closely fitted within an inner surface of the shell.

Another aspect of the present invention relates to a manufacturing method for a connector according to the above aspect of the present invention, wherein the housing and the contact which form an integral unit by means of the joining member and which are arranged inside the shell with the joining member are heat treated so that the joining member is softened and is integrally adhered to the inner surface of the shell, thereafter the joining member and the shell are fixed to each other.

According to the first aspect of the present invention, since the joining member is closely fitted within the inner surface of the shell, the connector can have a water proof capability without a use of sealing members such as an O-ring, thus the number of components thereof can be reduced and the connector can be easily miniaturized and assembled.

According to the second aspect of the invention, since the joining member is integrally fixed to the inner surface of the shell, the water proof capability can be obtained without a need for forming the inner surface of the shell into a smooth surface, thus the manufacturing flexibility can be increased.

According to the third aspect of the invention, since the housing and the contact are integrally formed by, for example, a molding method, therefore, the connector can be easily assembled.

According to the fourth aspect of the invention, since the partial members of the housing both of which embed the contacts are integrally assembled together by means of the joining member, the connector can have contacts on both sides thereof. Further, since the plurality of partial members of the housing can be integrally assembled by means of the joining member, the connector can be easily assembled.

According to the fifth aspect of the invention, since the joining member is formed of a resin material which has an adhesiveness when the resin material is heat treated, the shell and the joining member can be integrally fixed to each other when the joining member disposed inside the shell is heat treated, thus the connector can have an enhanced water proof capability nevertheless the inner surface of the shell is not smooth surface.

According to the sixth aspect of the invention, the joining member can be heat treated without deforming the shape of the housing.

According to the above aspect of the present invention regarding the manufacturing method for the connector, the connector having a water proof capability can be manufactured without a use of sealing members such as an O-ring.

According to another aspect of the invention regarding the manufacturing method for the connector, since the joining member and the inner surface of the shell are integrally adhered to each other, the connector can have a more enhanced water proof capability, and since the joining member is softened, the connector can have a water proof capability nevertheless the inner surface of the shell is not smooth surface.

BRIEF DESCRIPTION OF THE DRAWINGS

FIG. 18A shows a perspective view of first contacts according to the third embodiment of the present invention. FIG. 18B shows a side elevational view thereof viewing from one side thereof.

EXEMPLARY EMBODIMENT OF THE INVENTION

Figure 1A:
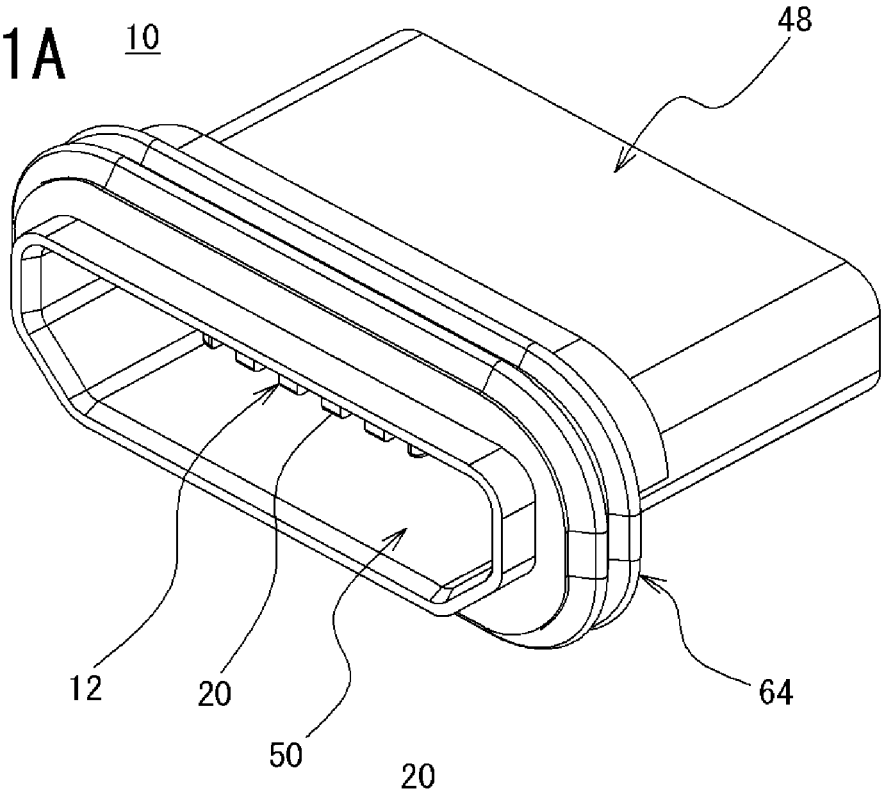
FIG. 1A shows a perspective view of a connector according to the first embodiment of the present invention viewing from one side thereof.
Figure 1B:
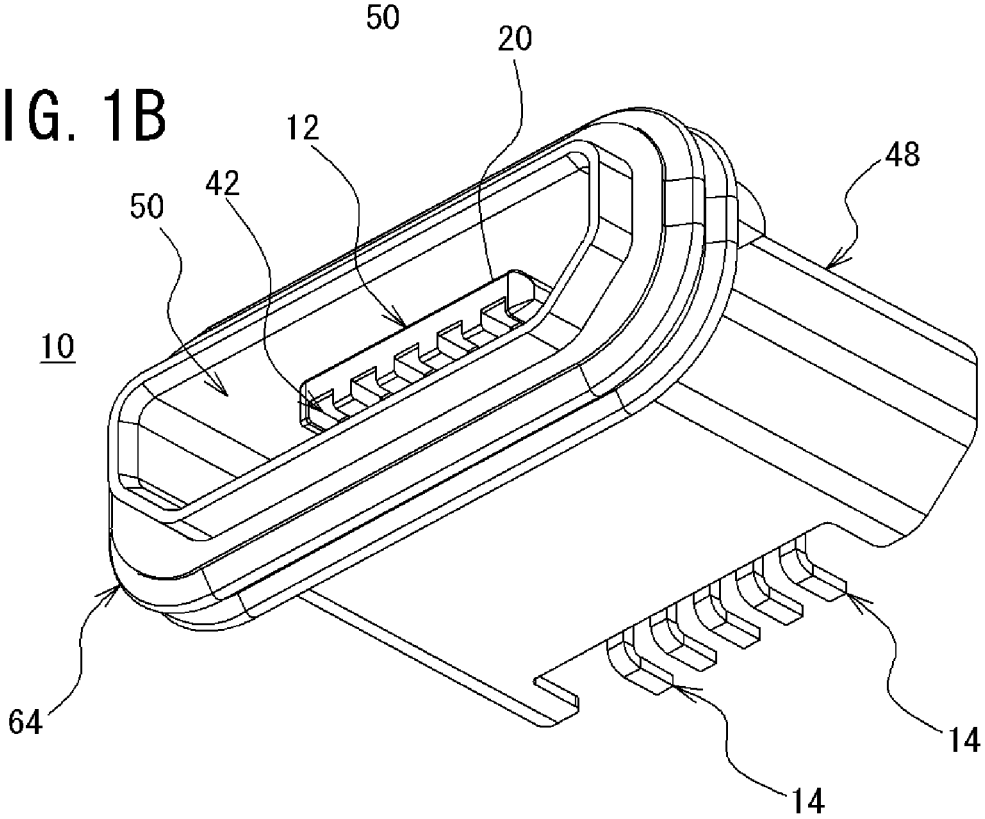
FIG. 1B shows another perspective view of the connector viewing from another side thereof.

Embodiments of the present invention will be described hereinafter with reference to the drawings. The following embodiments are to exemplify a connector for embodying the technical concept of the present invention, and are not intended to limit the present invention into these embodiments but can also be equally applicable to other embodiments within the scope of the claims.

Embodiment 1

First of all, a connector 10 according to the first embodiment of the present invention will be explained with reference to FIGS. 1A, 1B, 2A, 2B, 2C, 3, 4A, 4B, 5A, 5B, 5C, 5D, 5E, 6A, 6B, 6C, 7A and 7B. The connector 10 in the first embodiment is mounted on a printed circuit board and is used with and connected with a counterpart connector (not shown). The connector 10 in the first embodiment has at one side an opening 50 into which the counterpart connector is inserted and has at the opposite side a configuration in which part of contacts 14 project therefrom and are connected with contacts formed on the printed circuit board. A gasket 64 for enhancing airtightness and water proof capability is attached around the external peripheral side of the opening 50 of the connector 10.

As shown in FIGS. 1A, 1B, 2A, 2B, 2C and 3, the connector 10 in the first embodiment includes a metal shell 48 around which the annular gasket 64 is attached, a housing 20 arranged inside the shell 48, and at least one contact 14 which is assembled in the housing 20. The housing 20 and the contact 14 are integrally assembled with the inner surface of the shell 48 by means of a joining member 44 which is made of resin. Each constitution thereof will be explained hereinafter.

Now, each member arranged inside the shell 48 will be explained with reference to FIGS. 2A, 2B, 2C, 3, 4A, 4B, 5A, 5B, 5C, 5D, 5E, 6A, 6B and 6C. In the connector 10 in the first embodiment, the housing 20, the contact 14, and the joining member 44 are arranged inside the shell 48. When the connector 10 is assembled, the housing 20 and the joining member 44 are integrally formed, thereafter, the contact 14 is attached to the housing 20 and the joining member 44, and finally, the whole assembled structures are inserted into the shell 48 to form the connector 10.

In the first embodiment, the contact 14 is, as shown in FIGS. 2C, 3, 4A and 4B, formed into a predetermined shape and as at least one, e.g. five metal rod members and they are aligned each other in a predetermined intervals. One side of each contact 14 is a contact part 16 for contacting with a mating contact (not shown) which is provided on the counterpart connector while the other side thereof is a connecting part 18 to be connected to the contact (not shown) formed on the printed circuit board by mans of solder welding. The contact 14 in the first embodiment is formed by being punched out from a metal plate and thereafter being bent. Each contact 14 in the first embodiment is formed into a so-called crank arm shape so that two points between the contact part 16 and the connecting part 18 are bent and that the contact part 16 and the connecting part 18 are formed in approximately parallel to each other. Further, each contact 14 in the first embodiment is formed into the same shape with the other contacts 14. However, the present invention is not limited to the above. The contacts 14 can have any different shapes.

The housing 20 in the first embodiment includes: as shown in FIGS. 2C, 5A, 5B, 5C, 5D, 5E, 6A, 6B and 6C, a housing main body 22 formed into a dimension being able to fill and closely fit within the internal space of the shell 48; and a contact supporting part 38 projecting from the one side of the housing main body 22 which are formed of a resin material.

The housing main body 22 has an upper surface 28, a bottom surface 30, a first side surface 32 and a second side surface 34 which will be fixed to the inner surface of the shell 48 and thereby filling the internal space of the shell 48 described later. The contact supporting part 38 is formed in a manner to project from a front surface 24 of the housing main body 22 which front surface 24 is the side to be connected to the counterpart connector. The front surface 24 of the housing main body 22 from which the contact supporting part 38 projects is the firstly-inserted-side which will be inserted into the shell 48 during the assembling process.

In the contact supporting part 38, the upper surface 28 is formed into a flat surface while the bottom surface 30 is formed with channels which number corresponds to the number of contacts 14. Each channel forms a contact receiving channel 40 into which the each contact is arranged. Each contact receiving channel 40 is formed up to the distal end of the contact supporting part 38 which end is opposite to the housing main body 22.

The housing 20 is formed at a back surface 26 opposite to the front surface 24 with contact inserting openings 36 which number corresponds to the number of contacts 14. Each contact inserting opening 36 is formed in a manner to penetrate through the housing main body 22 so that the contact inserting opening 36 communicates with the contact receiving channel 40 formed on the contact supporting part 38 which is provided on the front side 24. The contact inserting opening 36 and the contact receiving channel 40 form a contact receiving part 42.

The joining member 44 in the first embodiment is, as shown in FIGS. 2C, 6A, 6B and 6C, integrally formed with the housing 20, thus the connector 10 can be easily assembled as described later. The joining member 44 is formed into a dimension which is able to closely fit within the internal surface of the shell 48 and thereby filling the internal space of the shell 48.

The joining member 44 is formed of a different resin material from the resin material which forms the housing 20. More specifically, the joining member 44 is formed of a material which displays adhesiveness when it is placed inside the shell 48 and thereafter processed with heat. The material is, for example, polyester elastomer. It is preferable that the melting point of the material which forms the joining member 44 is lower than the melting point of the resin material which forms the housing 20. The housing 20 is formed of a material such as nylon and LCP (Liquid Crystal Polymer).

The joining member 44 is integrally formed, for example, by means of molding method with the housing 20 which is previously formed. During the molding process, the joining member 44 is formed at the back surface 26 side of the housing 20, thus the through holes 46 each of which communicates with the respective contact inserting opening 36 are formed at the positions corresponding to the respective contact inserting openings 36 which are formed on the back surface 26 of the housing 20.

The shell 48 in the first embodiment has, as shown in FIGS. 1A, 1B, 2A, 2B, 2C, 7A and 7B, an opening 50 at one side into which the counterpart connector is inserted and an inserting port 52 at the other side from which the connecting part 18 of each contact 14 protrudes and into which each member such as housing 20 is inserted during the assembling process of the connector 10. Further, the shell 48 is formed as a metallic cylindrical body including a top plate 54, a bottom plate 56, a first side plate 60 and a second side plate 62 and is formed by being punched out from a metal plate and bent.

The opening 50 of the shell 48, into which the counterpart connector is inserted, is formed along the internal peripheral thereof with a taper so that the counterpart connector can be smoothly inserted thereto. The inserting port 52 which is formed at the opposite side to the opening 50 and from which each contact 14 protrudes is formed on the bottom plate 56 with a notch 58 from which the contacts 14 protrude.

The peripheral surface formed by the top plate 54, the bottom plate 56, the first side plate 60, and the second side plate 62 of the shell 48 is provided with a gasket 64 as shown in FIGS. 1A, 1B, 2A, 2B and 2C. The gasket 64 is formed of a resin material and is integrally formed with the shell 48 by, for example, a molding method.

An assembling method (manufacturing method) of the connector 10 in the first embodiment will be explained hereinafter. In order to assemble the connector 10 in the first embodiment, first of all, the housing 20 is attached to the joining member 44 so that they form an integral member. This attachment process is carried out by arranging the housing 20 which is formed into a predetermined shapes inside a mold for forming the joining member 44, then by being molded with a resin material which forms the joining member 44 at the back surface 26 side of the housing, thus the housing 20 and the joining member 44 are integrally formed as one unit. During this molding process, the joining member 44 is formed with through holes 46 so that each through hole corresponds to each contact inserting opening 36 which is formed on the housing main body 22 of the housing 20.

Figure 2A:
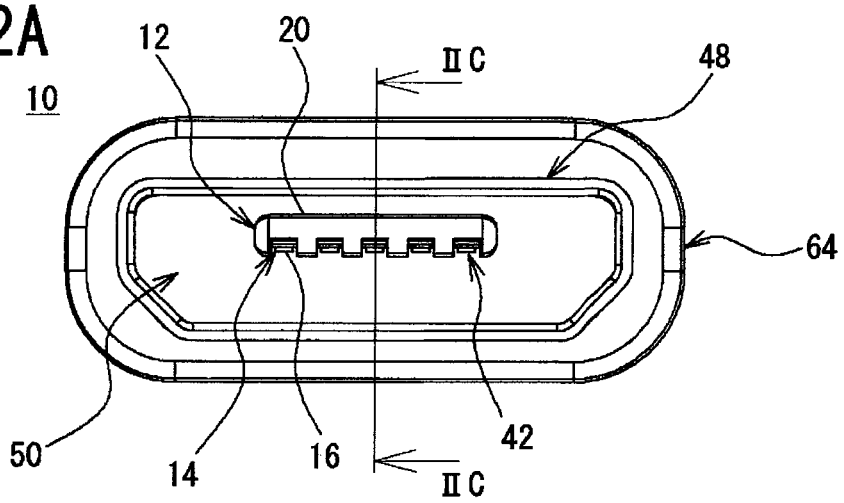
FIG. 2A shows a front elevational view of the connector according to the first embodiment of the present invention.
Figure 2B:
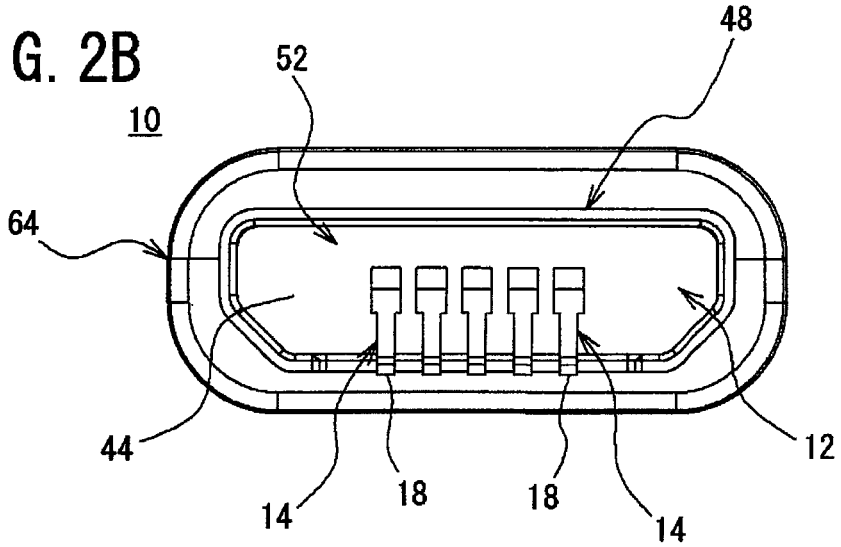
FIG. 2B shows a rear elevational view of the connector.
Figure 2C:
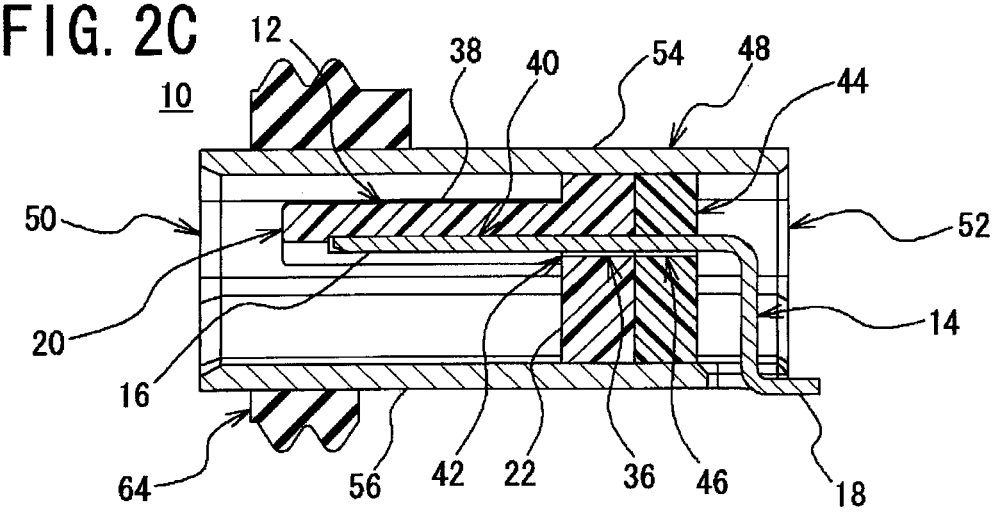
FIG. 2C shows a cross-sectional view at IIC-IIC line in FIG. 2A.
Figure 3:
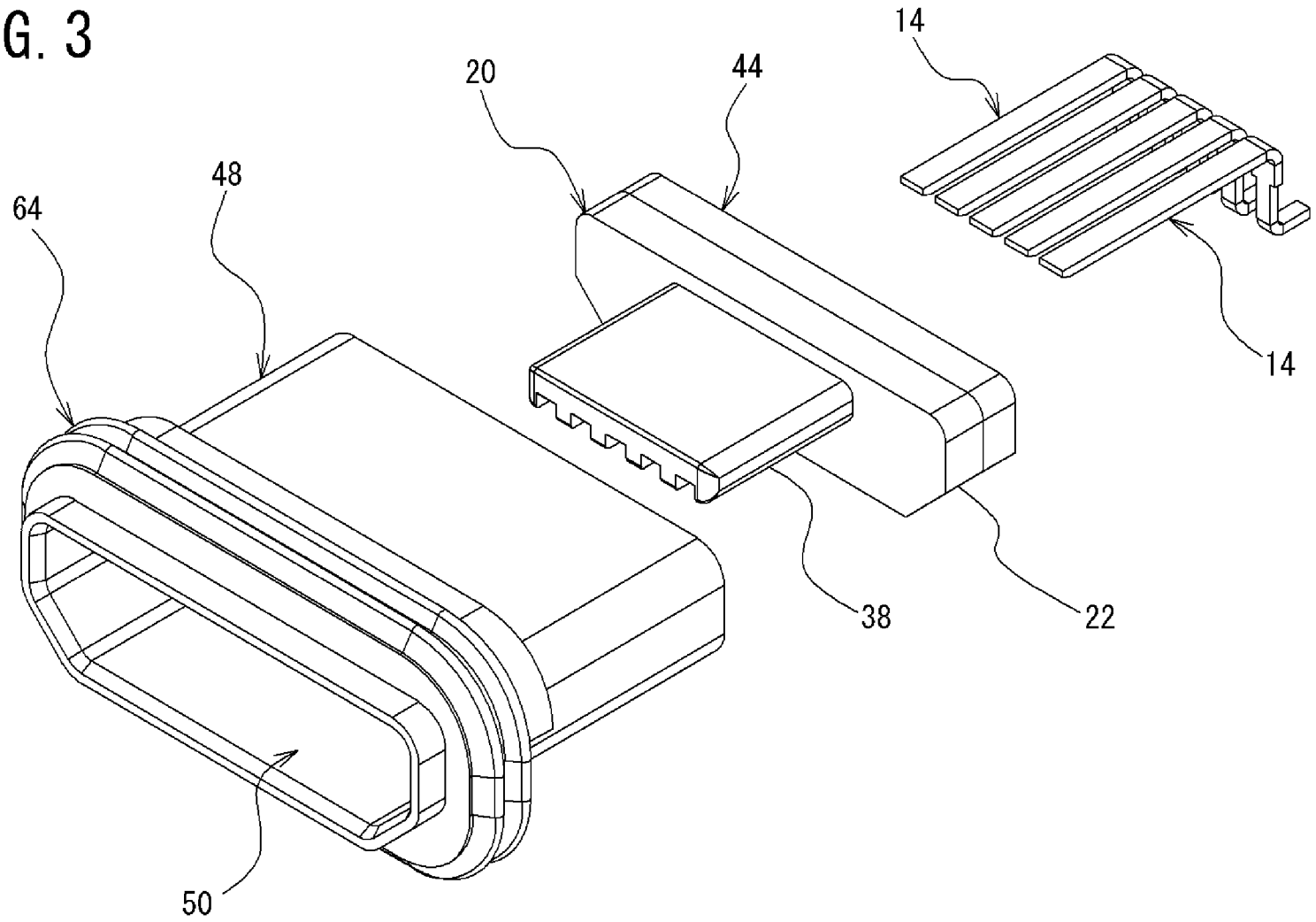
FIG. 3 shows an exploded perspective view of the connector according to the first embodiment of the present invention.
Figure 4A:
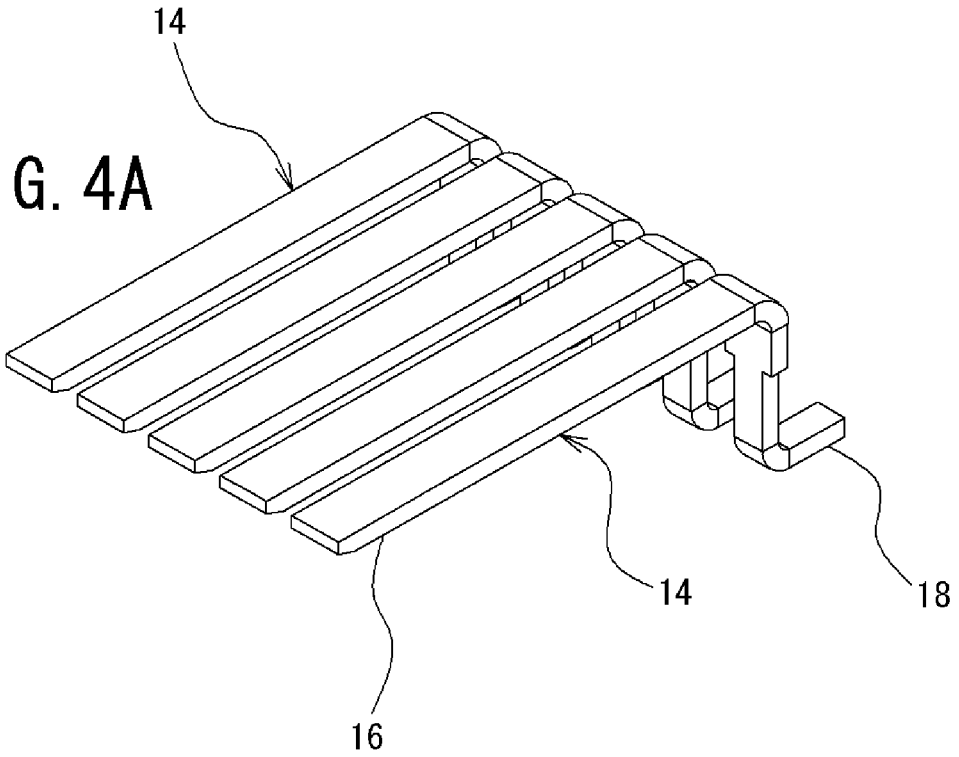
FIG. 4A shows a perspective view of contacts according to the first embodiment of the present invention.
Figure 4B:
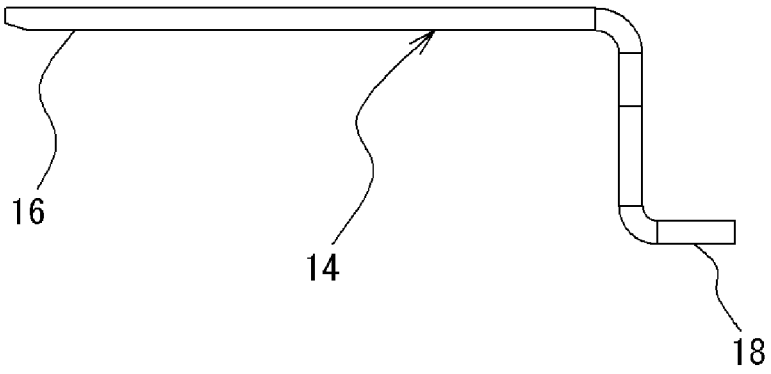
FIG. 4B shows a side view of the contacts viewing from one side thereof.
Figures 5A, 5B, 5C, 5D, 5E:
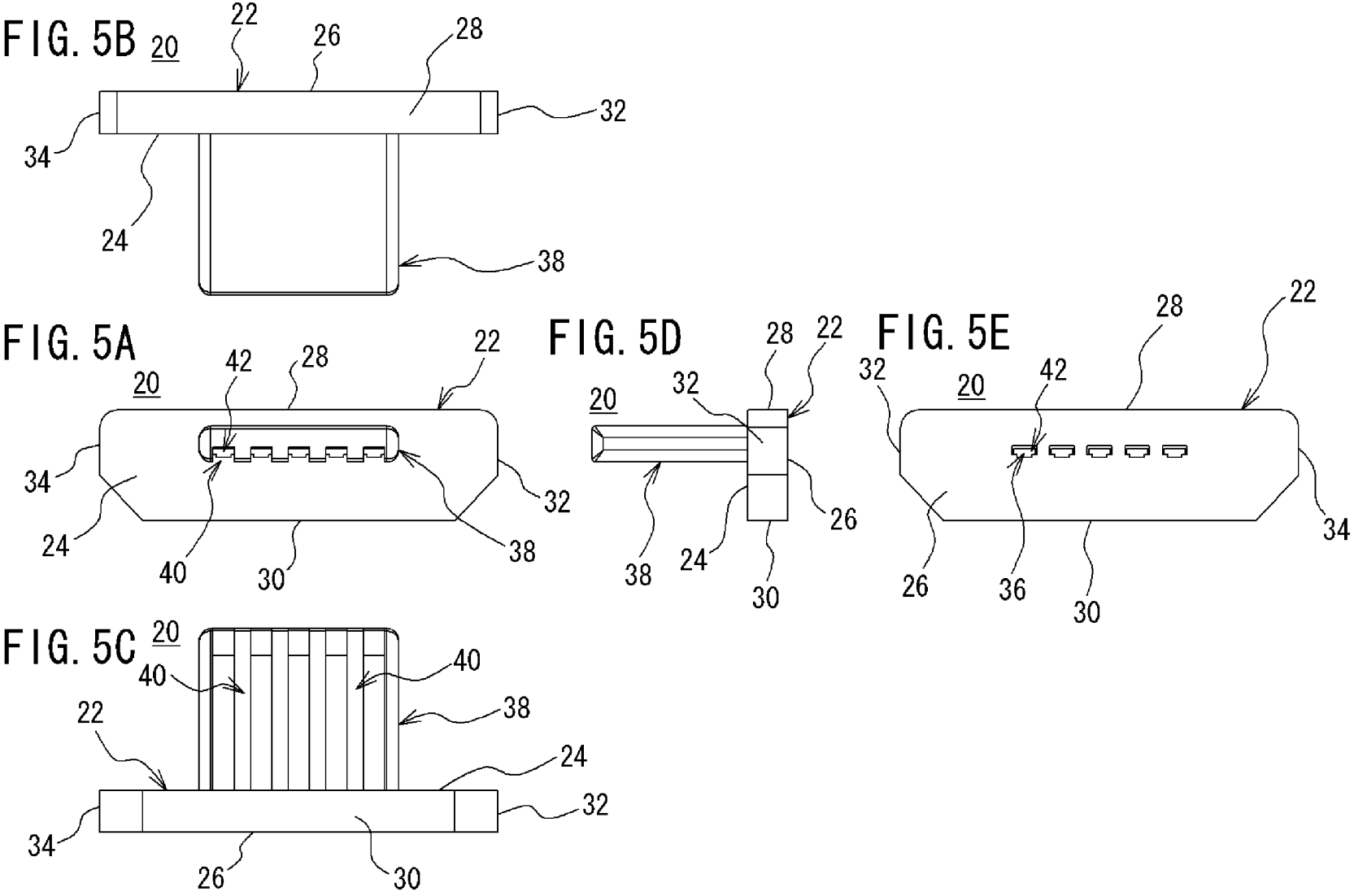
FIG. 5A shows a front elevational view of a housing of the connector according to the first embodiment of the present invention.
FIG. 5B shows a plan view thereof.
FIG. 5C shows a bottom view thereof.
FIG. 5D shows a side elevational view thereof viewing from one side thereof.
FIG. 5E shows a rear side elevational view thereof.
Figure 6A:
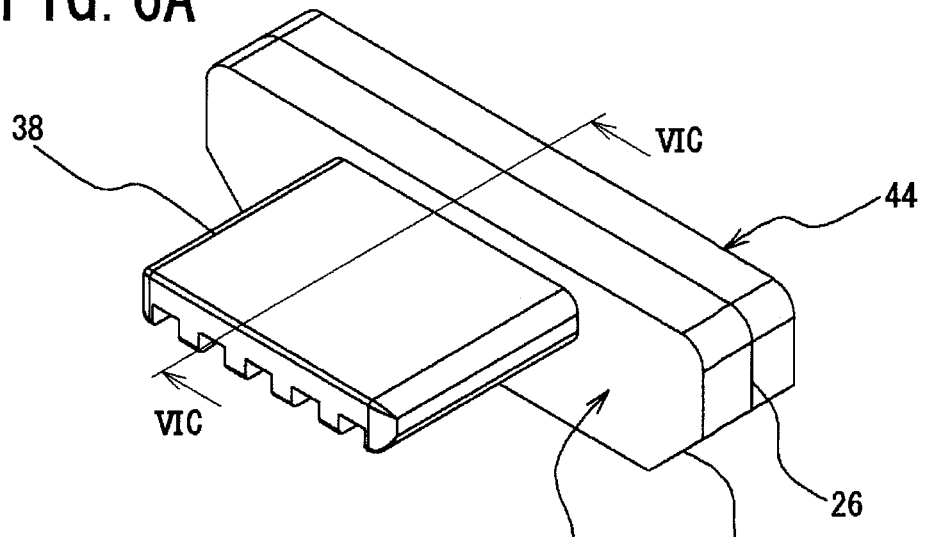
FIG. 6A shows a perspective view of the housing of the connector according to the first embodiment of the present invention in a state in which a joining member is attached thereto.
Figure 6B:
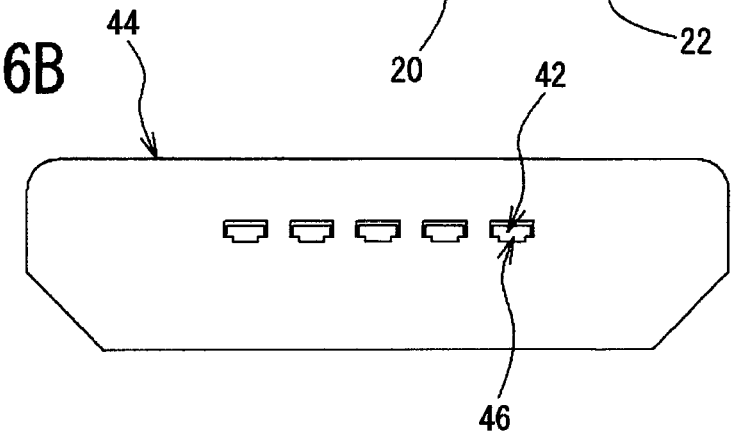
FIG. 6B shows a rear side elevational view thereof.
Figure 6C:
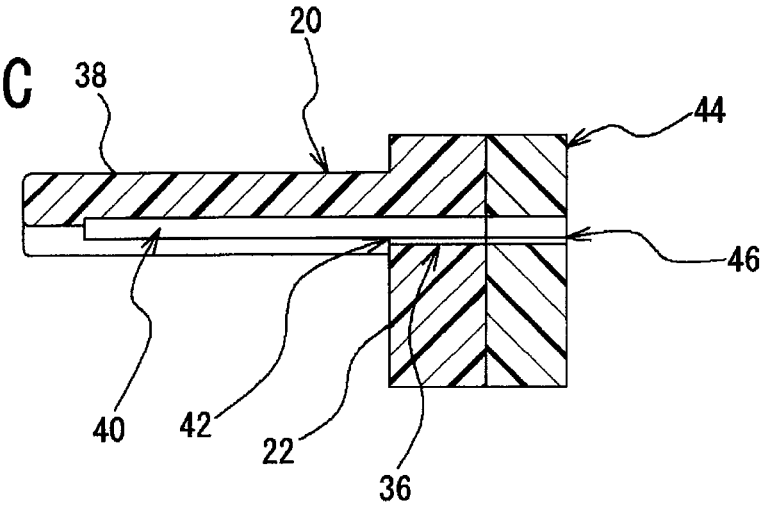
FIG. 6C shows a cross-sectional view at VIC-VIC line in FIG. 6A.
Figure 7A:
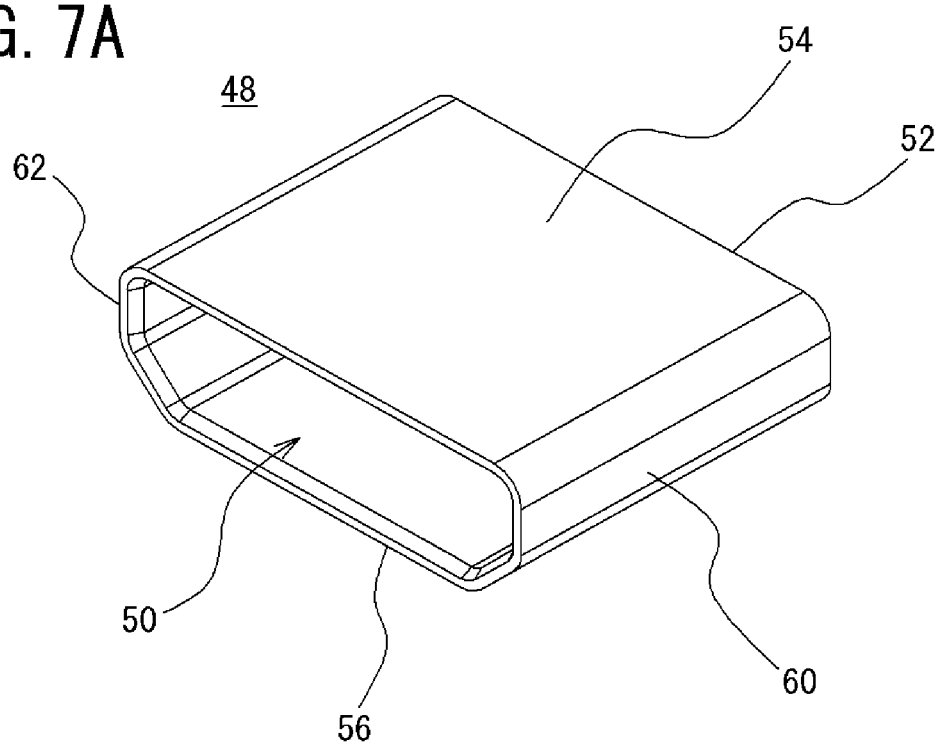
FIG. 7A shows a perspective view of a shell according to the first embodiment of the invention viewing from one side thereof.
Figure 7B:
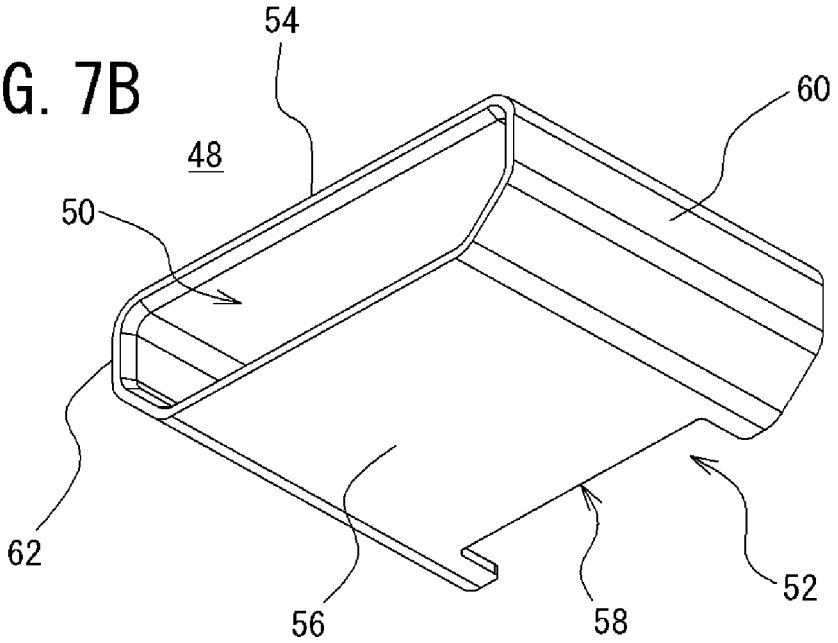
FIG. 7B shows another perspective view of the shell viewing from another side thereof.

Thereafter, each contact 14 is inserted into the contact receiving part 42 (refer FIG. 2C). This insertion is accomplished by inserting the contact part 16 of the each contact 14 into the contact receiving part 42 from the through holes 46 side which is formed on the joining member 44. Each contact 14 is inserted up to the predetermined position of the contact supporting part 38 of the housing 20. At the moment of this insertion process, each contact 14 is not fixed to the housing 20. The unit formed by the housing 20, the contacts 14 and the joining member 44 which are assembled together is hereinafter referred to as "housing unit 12".

Thereafter, the housing unit 12 is inserted into the inside of the shell 48 (refer FIG. 2C). The housing 20 is inserted into the shell 48 from the inserting port 52 side thereof, thus the housing 20 and the joining member 44 are positioned at the predetermined place inside the shell 48 and each contact is positioned at the predetermined place. By this insertion process, the joining member 44 is closely fitted within the inner surface of the shell 48, thus the inside of the shell 48 is closed.

Thereafter, the housing unit 12 being kept within the shell is thermally treated in, for example, a high temperature oven. By this thermal process, the joining member 44 is softened and adhered to the internal surface of the shell 48. As the temperature decreases, the joining member 44 is hardened and fixed to the shell 48, and the joining member 44 and the contacts 14 are integrally fixed to each other. The temperature of the thermal process should be lower than the melting point of the resin material forming the housing 20 and be the same as or slightly lower than the melting point of the resin material forming the joining member 44 in which temperature the resin material of the joining member 44 can be softened.

The gasket 64 which is provided around the outer periphery of the shell 48 can be attached to the shell 48 in advance or can be formed together with the joining member 44.

The connector 10 in the first embodiment is thus assembled. The connector 10 in the first embodiment, by employing the above constitution, can provide a water proof capability by the joining member 44 without a need of sealing members such as an O-ring, thus the manufacturing cost thereof and the assembling steps thereof can be decreased.

Since the joining member 44 is softened and adhered to the inner surface of the shell 48 during the thermal process, thus the joining member 44 can be attached without any space therebetween to the shell regardless whether the inner surface of the shell is smooth surface or not, thereby providing a high waterproof capability.

In the connector 10 of the above first embodiment, it is described that the joining member 44 is formed of a material which provides adhesiveness when it is heat-treated. However, the present invention is not limited to the above embodiment. The joining member 44 can also be formed of a material which provides adhesiveness when it is integrally formed with the housing by molding process such as thermoplastic polyester resin. In this way, since the joining member 124 can provide adhesiveness against the shell when the joining member 124 is placed inside the shell. This can provide a water proof capability. Therefore, the use of sealing members such as an O-ring can be omitted.

In the connector 10 in the above first embodiment, it is described that the housing 20, the joining member 44, and the contacts 14 are assembled together in advance to inserting the assembled unit into the shell 48. However, the present invention is not limited above embodiment. The housing 20 and the joining member 44 can be inserted into the inside of the shell 48 firstly, and thereafter, each contact 14 can be attached to the housing 20 and the joining member 44, and finally, the assembled unit can be thermally processed.

In the above first embodiment, it is also described that the gasket 62 is integrally formed with the shell 48. However, the present invention is not limited the above embodiment. The gasket can be separately formed and be lately attached to the shell 48.

Second Embodiment

Referring now to FIGS. 8A, 8B, 8C, 9A, 9B, 10A, 10B, 10C, 11A, 11B and 11C, a connector 10A according to the second embodiment of the present invention will be described. In the connector 10 in the first embodiment, the housing 20 and the joining member 44 are integrally formed with respect to each other during the assembly previous to the attachment of the contacts 14. However, in the connector 10A in the second embodiment, the housing 20 and the contacts 14 are integrally formed with respect to each other during the assembly previous to the attachment of the joining member 44. Here, since the connector 10A in the second embodiment has the same as the connector 10 in the first embodiment except for one part of the assembling process thereof, the same reference numeral will be given to the constitution which is common to the connectors, and the detailed explanation will be omitted.

The connector 10A in the second embodiment is, as shown in FIGS. 8A, 8B, 8C, 9A and 9B, used for be mounted onto a substrate and being connected with a counterpart connector (not shown) in the same manner with the connector 10 in the first embodiment. The connector 10A in the second embodiment has at one side an opening 50 to which the counterpart connector is inserted and has at the other side a configuration in which a part of contacts 14 project therefrom and are connected with contacts formed on a printed circuit board when the connector 10A is installed thereon. A gasket 64 for enhancing airtightness and water proof capability is attached around the external periphery of the opening 50 of the connector 10A.

Figure 8A:
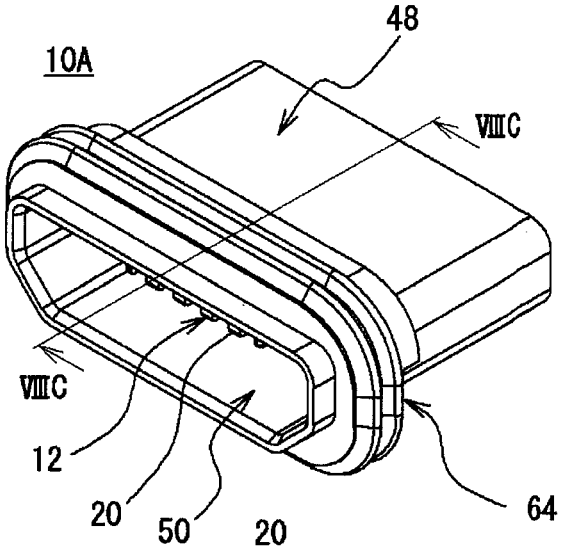
FIG. 8A shows a perspective view of a connector according to the second embodiment of the present invention viewing from one side thereof.
Figure 8B:
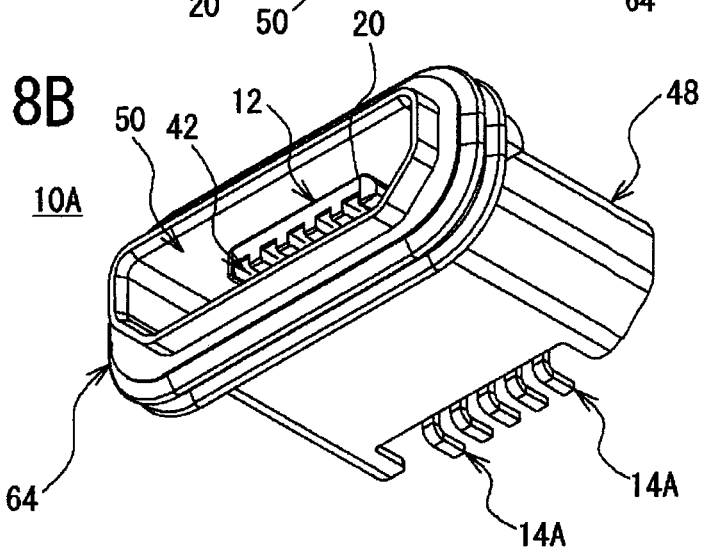
FIG. 8B shows another perspective view of the connector viewing from another side thereof.
Figure 8C:
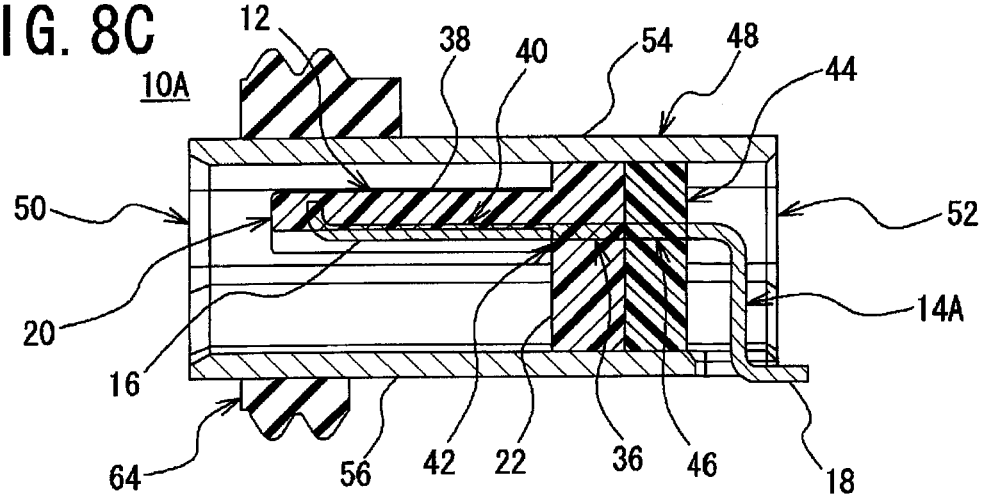
FIG. 8C shows a cross-sectional view at VIIIC-VIIIC line in FIG. 8A.
Figure 9A:
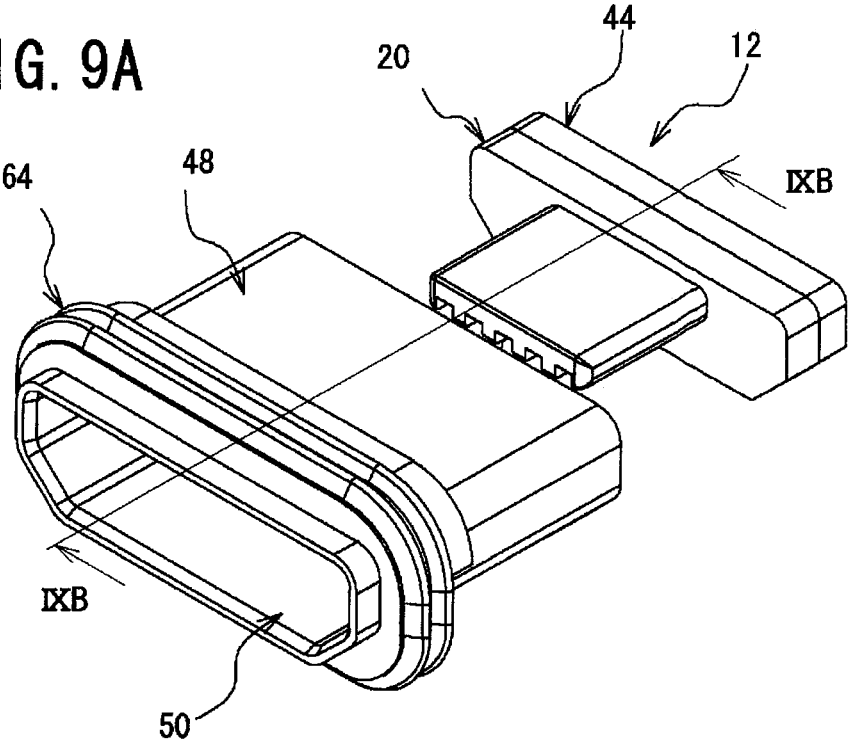
FIG. 9A shows an exploded perspective view of the connector according to the second embodiment of the present invention.
Figure 9B:
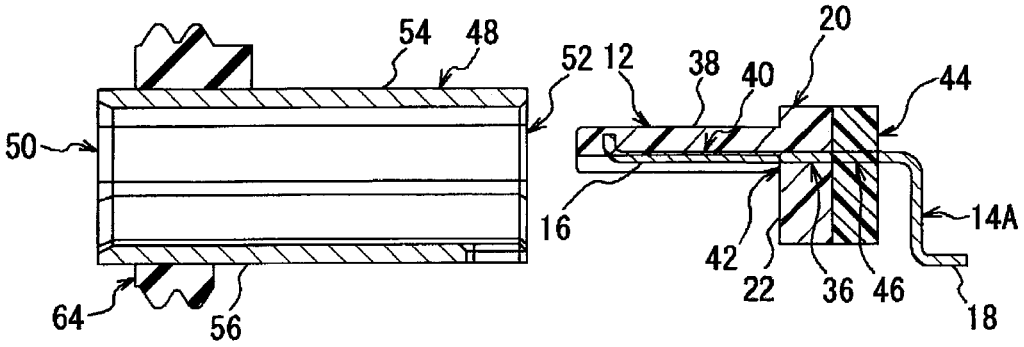
FIG. 9B shows a cross-sectional view at IXB-IXB line in FIG. 9A.

Each constitution of the connector 10A in the second embodiment is the same as the constitution of the connector 10 in the first embodiment. As shown in FIGS. 8A, 8B and 8C, the connector 10A has a metal shell 48 around which the annular gasket 64 is attached, a housing 20 arranged inside the shell 48, and at least one contact 14A which is assembled in the housing 20. The housing 20 and the contact 14 are assembled integrally with the inner surface of the shell 48 by means of a joining member 44 which is made of resin.

Figure 10A:
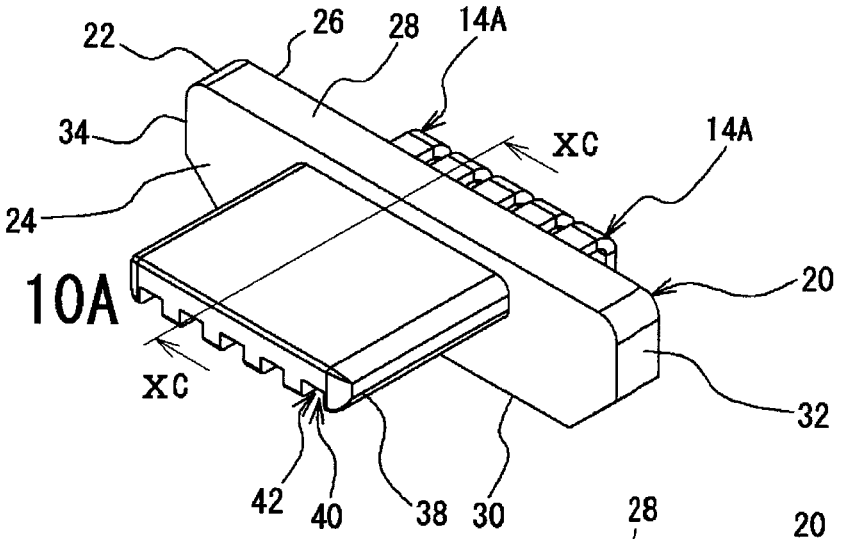
FIG. 10A shows a perspective view of the housing and the contact according to the second embodiment of the present invention viewing from one side in a state in which the housing and the contact are assembled.
Figure 10B:
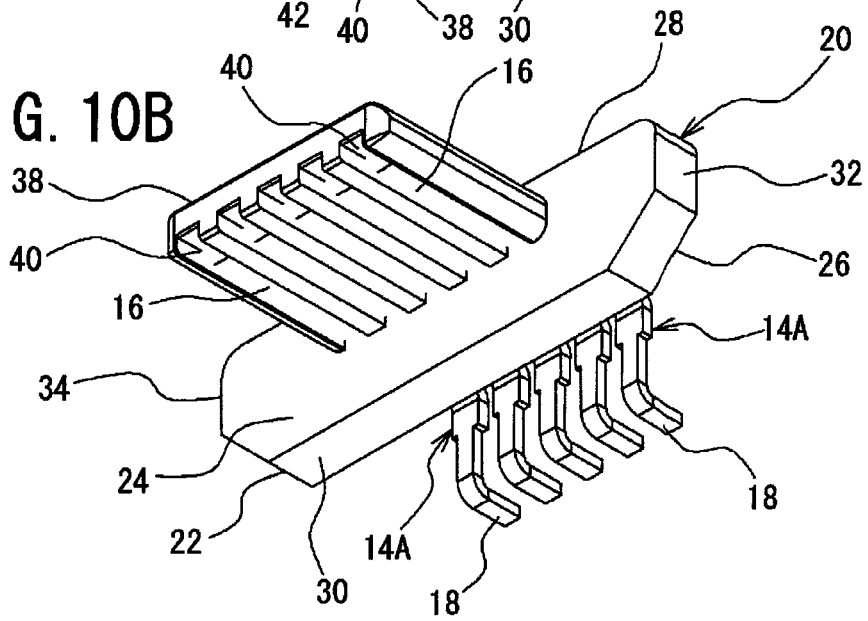
FIG. 10B shows another perspective view thereof viewing from another side thereof.
Figure 10C:
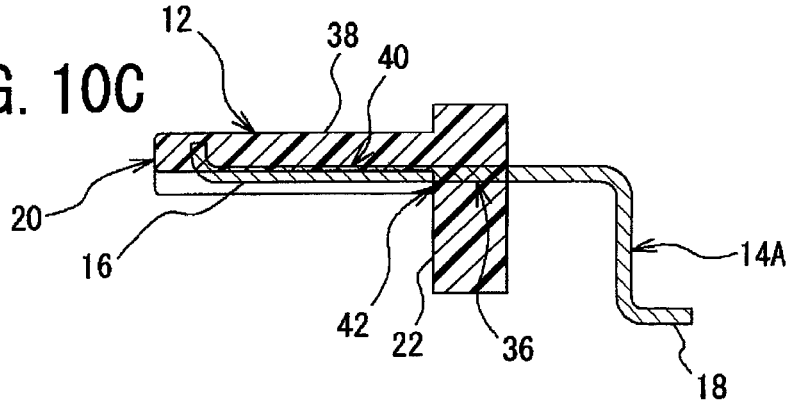
FIG. 10C shows a cross-sectional view at XC-XC line in FIG. 10A.

The contact 14A in the second embodiment is, as shown in FIGS. 8C and 10C, formed so that the contact part 16 thereof is bent toward the housing 20 in contrast to the contact 14 in the first embodiment. In this way, since the bent portion of the contact 14A is embedded into the housing 20 when the contact 14A is molded, thus the integration of the contact 14A to the housing 20 is further achieved.

Since the other constitutions of the contact 14A, housing 20, joining member 44, shell 48 and gasket 64 in the second connector are the same as the ones in the first embodiment, therefore, the detailed explanation will be omitted.

An assembling method (manufacturing method) of the connector 10A in the second embodiment will be explained hereinafter. Comparing the connector 10A in the second embodiment with the connector 10 in the first embodiment, the assembling method of the housing 20 and the contacts 14 and the attachment method of the joining member 44 are different.

First, the housing 20 is integrally formed with the contacts 14 (refer FIGS. 9A, 9B, 10A, 10B and 10C). This is carried out by arranging the contacts 14 each of which is previously formed into a predetermined shape in a metal mold for forming the housing 20, then, by being molded with a resin material which forms the housing 20, thus the contacts 14 and the housing 20 are integrally formed as one unit.

Figure 11A:
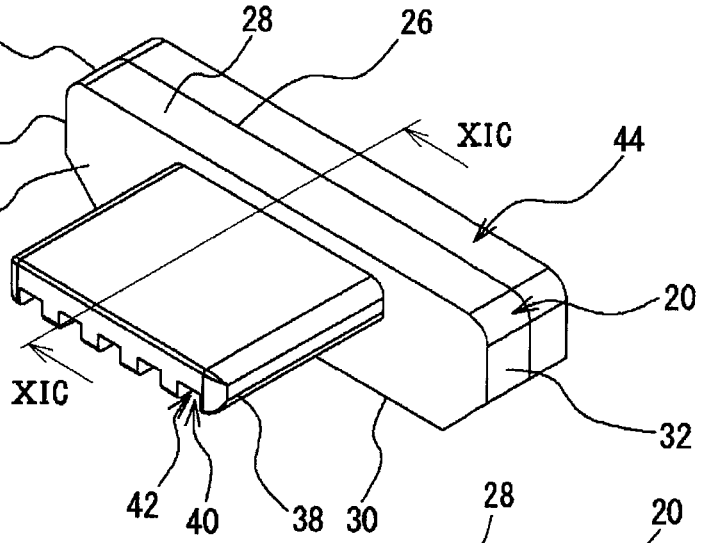
FIG. 11A shows a perspective view of a housing unit according to the second embodiment of the present invention viewing from one side thereof.
Figure 11B:
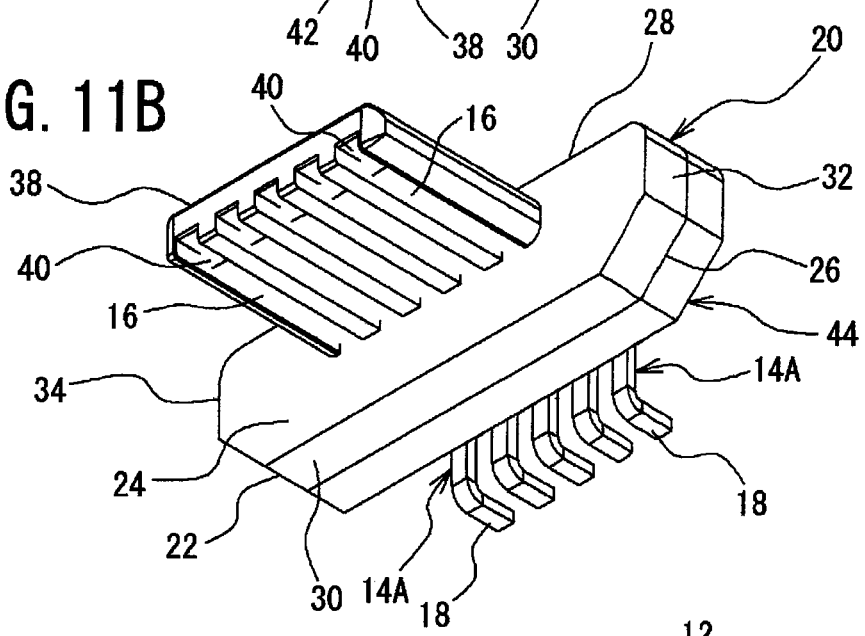
FIG. 11B shows another perspective view thereof viewing from another side thereof.
Figure 11C:
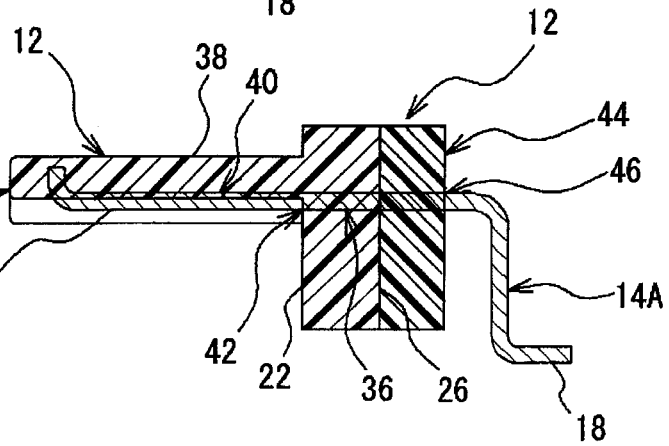
FIG. 11C shows a cross-sectional view at XIC-XIC line in FIG. 11A.
Figure 12A:
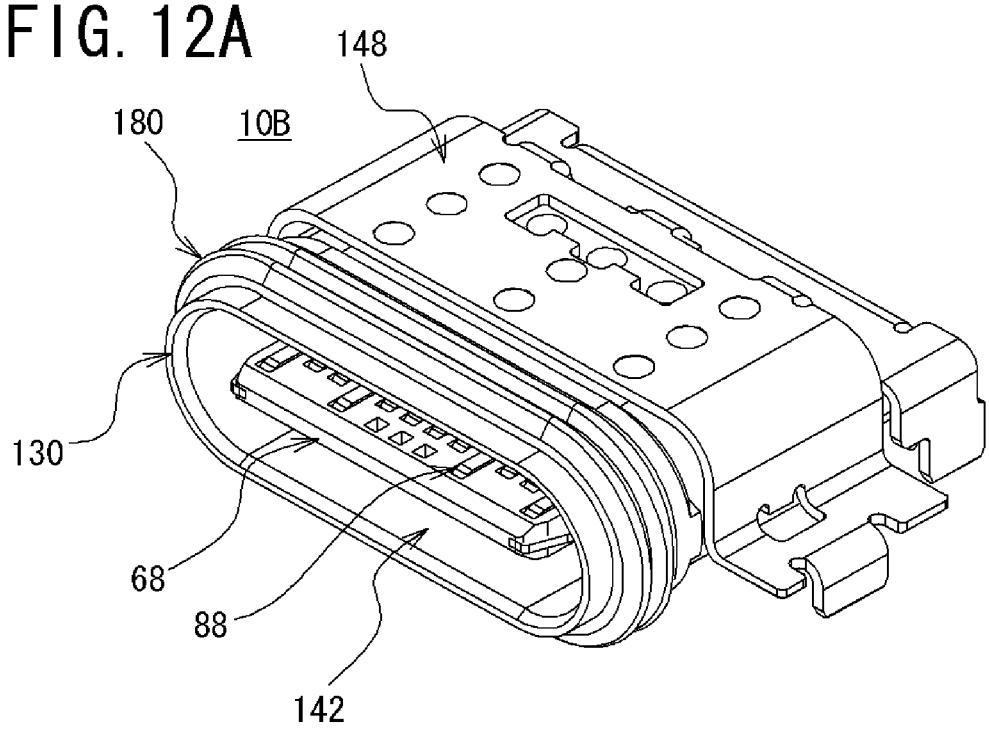
FIG. 12A shows a perspective view of a connector according to the third embodiment of the present invention viewing from one side thereof.
Figure 12B:
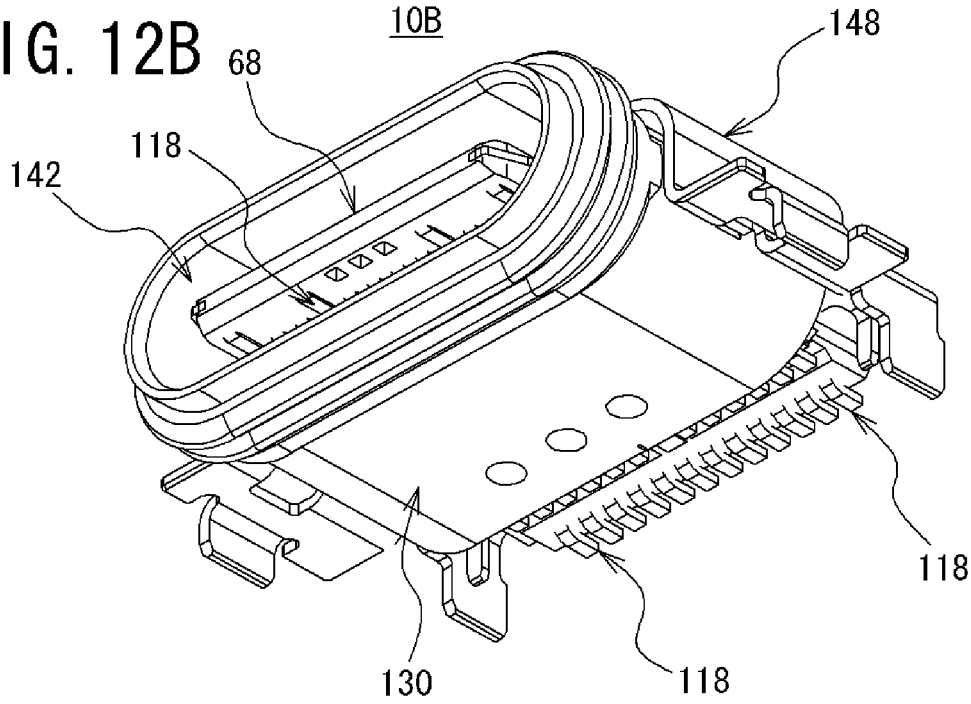
FIG. 12B shows another perspective view thereof viewing from another side thereof.

The joining member 44 is then attached to the contacts 14 and the housing 20, which are previously integrally formed, so that they form an integral unit (refer FIGS. 11A, 11B and 11C). This attachment process is carried out by arranging the contacts 14 and the housing 20 inside a mold for forming the joining member 44, then by being molded with a resin material which forms the joining member 44 at the back surface 26 side of the housing 20, thus the housing 20 and the joining member 44 are integrally formed as one unit. The joining member 44 is formed of a different resin material from the one forming the housing 20 as explained in the first embodiment.

The unit formed by the housing 20, the contacts 14, and the joining member 44 which are integrally formed together is hereinafter referred to as "housing unit 12".

Thereafter, the housing unit 12 is inserted from the inserting port 52 side of the shell 48 into the inside thereof and is kept in a predetermined position. Then they are thermally treated in a high temperature oven in the same manner with the first embodiment. By this thermal process, as the same with the first embodiment, the joining member 44 is softened and adhered to the internal surface of the shell 48. As the temperature decreases, the joining member 44 is hardened and fixed to the shell 48, and they are integrally fixed to each other (refer FIGS. 8A, 8B and 8C).

The gasket can be integrally formed in the same manner with the first embodiment. However, the gasket can also be separately formed.

The connector 10A in the second embodiment is thus assembled. By employing the above constitution, the connector 10A can have a water proof capability without a use of sealing member such as an O-ring, and can more easily be assembled.

Third Embodiment

Referring now to FIGS. 12A, 12B, 13A, 13B, 13C, 14, 15A, 15B, 16A, 16B, 17A, 17B, 17C, 18A, 18B, 19A, 19B, 19C, 20A, 20B, 21A, 21B, 22A, 22B, 22C, 23A, 23B, 24A and 24B, a connector 10B according to the third embodiment will be described. In the connector 10 in the first embodiment and the connector 10A in the second embodiment, it is described that the contacts 14, 14A are arranged in one row, i.e. the contacts 14, 14*a* are of one-sided contacts. In contrast, in the connector 10B in the third embodiment, contacts are arranged in two rows in order for providing double-sided contacts.

The connector 10B in the third embodiment is, as the same with the connector 10, 10A in the first and second embodiments, mounted on a printed circuit board and connected with a counterpart connector. However, the connector 10B is configured so that the contacts are arranged in two rows to provide double-sided contacts.

As shown in FIGS. 12A, 12B, 13A, 13B, 13C and 14, the connector 10B in the third embodiment has a housing unit 68 in which a plurality of contacts 88, 118 is integrally formed with a housing so that the contacts 68, 118 are arranged in a predetermined intervals, a metal shell 130 inside which the housing unit 68 is accommodated and is attached therewith, and a metal reinforcement member 148 attached around the metal shell 130 in a manner to cover the metal shell 130. A part of the plurality of contacts 88, 118 and the reinforcement member 148 are fixed to a substrate by solder welding, thus the connector 10B is mounted onto the substrate.

Referring now to FIGS. 15A, 15B, 16A, 16B, 17A, 17B, 17C, 18A, 18B, 19A, 19B, 19C, 20A, 20B, 21A and 21B, the housing unit 68 in the third embodiment will be described. The housing unit 68 in the third embodiment includes, as shown in FIGS. 15A, 15B, 16A and 16B, a first housing 70 with which a plurality of first contacts 88 is integrally formed, a plurality of second contacts 118, and a second housing 94 with which a metal plate member 112 is integrally formed. The first housing 70 and the second housing 94 are attached together by a joining member 124 so that they form one unit and are thus assembled together. The joining member 124 is to be integrally attached to the inner surface of the metal shell 130.

Metal cover members 172 are attached to the joining member 124 of the housing unit 68 at both the first housing 70 side and the second housing 94 side. These cover members 172 are used for shielding noise such as electromagnetic waves.

Figure 17A:
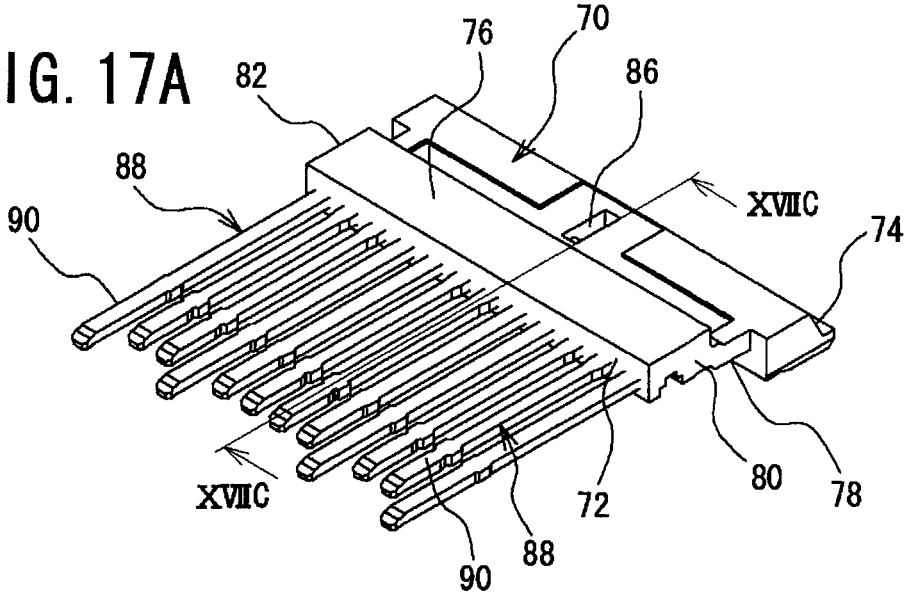
FIG. 17A shows a perspective view of a first housing according to the third embodiment of the present invention viewing from one side thereof.
Figure 17B:
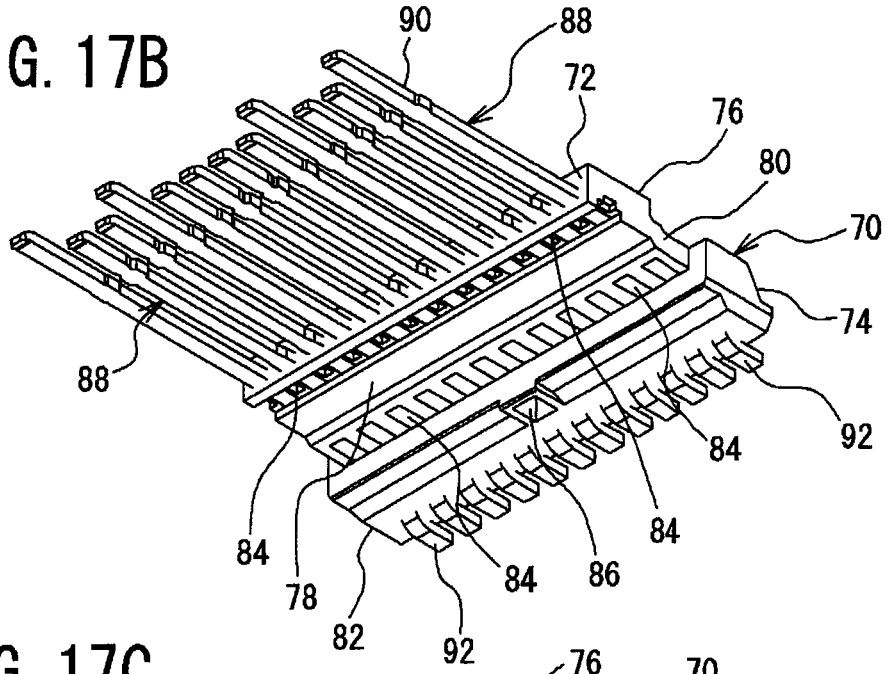
FIG. 17B shows another perspective view thereof viewing from another side thereof.
Figure 17C:
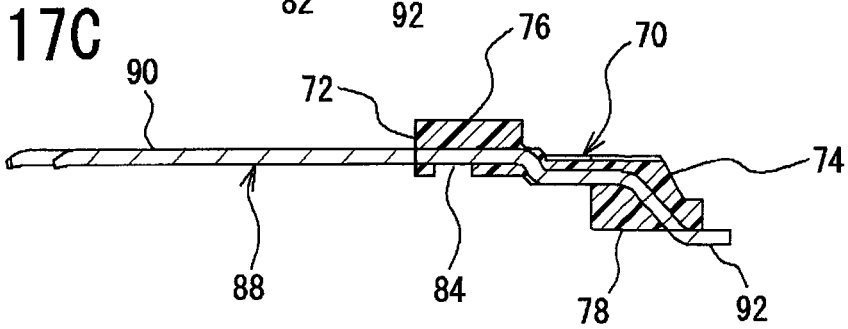
FIG. 17C shows a cross-sectional view at XVIIC-XVIIC line in FIG. 17A.

Referring now to FIGS. 17A, 17B, 17C, 18A and 18B, the first housing 70 will be described. The first housing 70 is, as shown in FIGS. 17A, 17B and 17C, integrally formed with at least one, e.g. twelve in this embodiment, first contacts 88 by a molding method.

The first contacts 88 of the first housing 70 are formed of metal rods each of which is formed into a predetermined shape and are placed side by side with predetermined intervals therebetween as shown in FIGS. 18A and 18B. One side of each first contact 88 is a first contact part 90 for contacting with a mating contact (not shown) of the counterpart connector while the other side thereof is a first connecting part 92 to be connected to the contact on the substrate by mans of solder welding. Each first contact 88 is formed by being punched out from a metal plate and thereafter being bent into a predetermined shape.

The first housing 70 is formed into a block shape body having a first front surface 72 from which the first contact parts 90 of the first contacts 88 are projected, a first rear surface 74 which is opposite to the first front surface 72, a first bottom surface 78 to be assembled with the second housing 94 and from which the first connecting parts 92 of the first contacts 88 are projected, a first upper surface 76 which is opposite to the first bottom surface 78, a first side surface 80, and another first side surface 82.

The first front surface 72 of the first housing 70 is formed into a planer shape and from which the first contacts 88 are projected with predetermined spaces.

The first upper surface 76 of the first housing 70 is formed with steps thereon. These steps are formed so that the first upper surface 76 of the first housing 70 at the first front surface 72 side is higher than the first upper surface 76 at the first rear surface 74 side. The first upper surface 76 is formed with a depression in one part. The depression is formed with a hole 86 which penetrates the first housing 70 toward the first bottom surface 78 at the approximate center thereof.

The first bottom surface 78 is also formed with steps thereon so that the first bottom surface 78 of the first housing 70 at the first front surface 72 side is higher than the first rear surface 74 side. The first connecting part 92 of each first contact 88 projects from the step on the first bottom surface 78 at the first rear surface 74 side. Each projected part of the first contact 88 is bent toward the first rear surface 74 side. The part of the first contact 88 bent toward the first rear surface 74 forms the first connecting part 92.

The first bottom surface 78 is formed with a plurality of first slots 84. The first slots 84 are formed at places where a part of each first contact 88 is exposed to the lower side in the first front surface 72 side, and are formed at places from the first side surface 80 to the other first side surface 82 of the approximate center of the first bottom surface 78 with predetermined spaces. Each first slot 84 is the part to which a joining member described later is assembled. The first slots 84 can be formed at any desirable places according to any technical requirements. The first bottom surface 78 is formed at the approximate center thereof with a hole 86 which penetrates through the first housing 70 from the first upper surface 76 thereof.

Figure 19A:
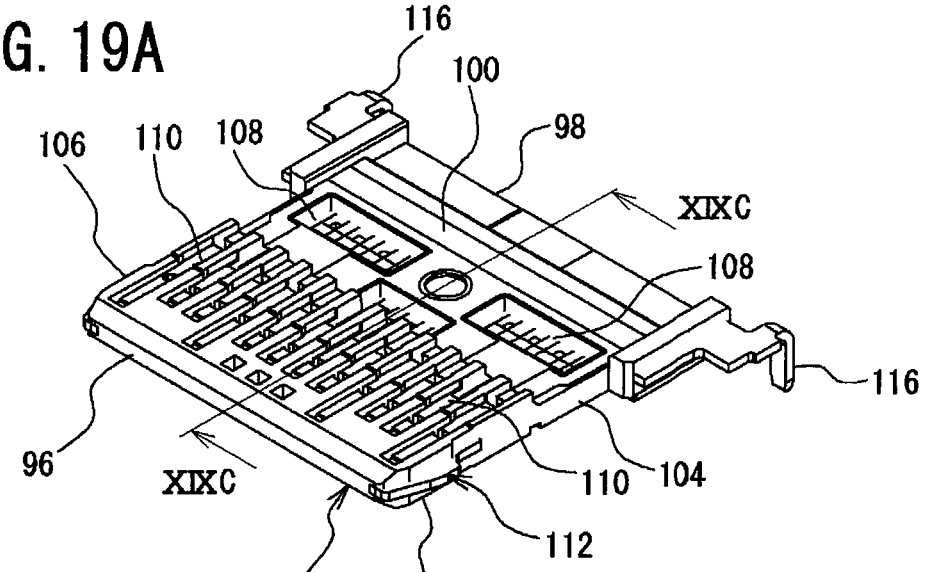
FIG. 19A shows a perspective view of a second housing according to the third embodiment of the present invention viewing from one side thereof.
Figure 19B:
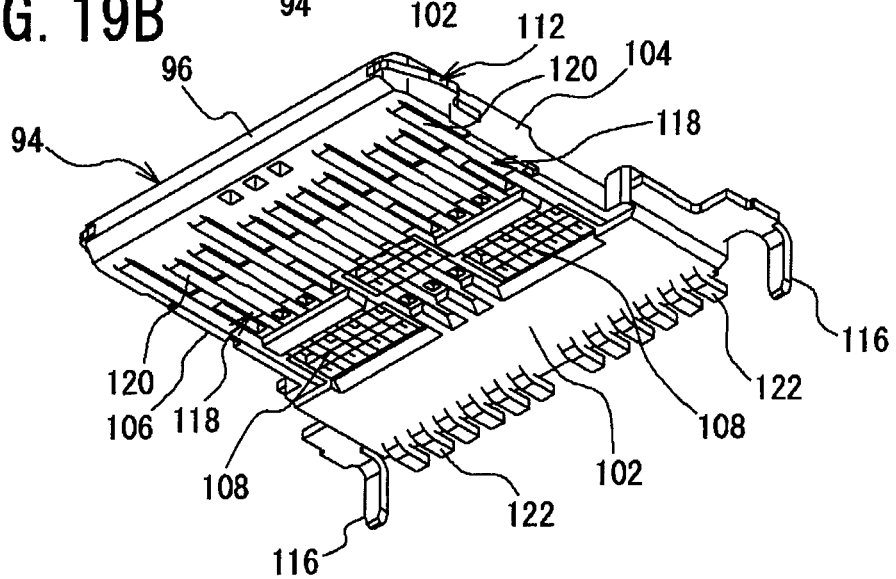
FIG. 19B shows another perspective view thereof viewing from another side thereof.
Figure 19C:
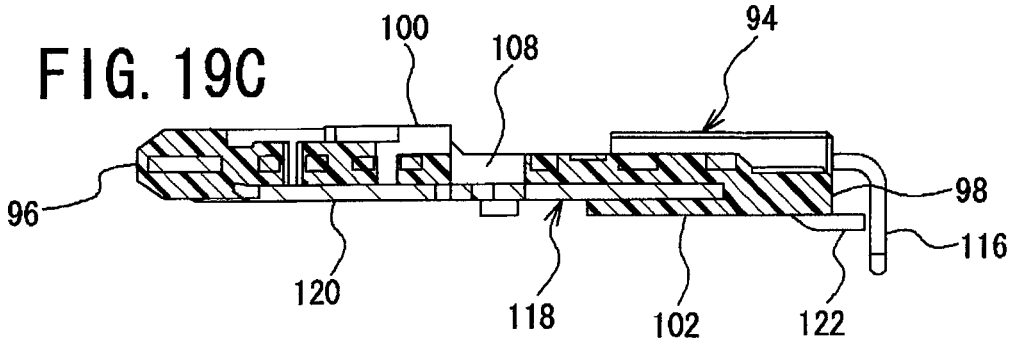
FIG. 19C shows a cross-sectional view at XIXC-XIXC line in FIG. 19A.

Referring now to FIGS. 19A, 19B, 19C, 20A, 20B, 21A and 21B, the second housing 94 will be described. The second housing 94 is, as shown in FIGS. 19A, 19B and 19C, integrally formed with the plate member 112 and at least one, e.g. twelve in the third embodiment, second contacts 118 by a molding method.

Figure 20A:
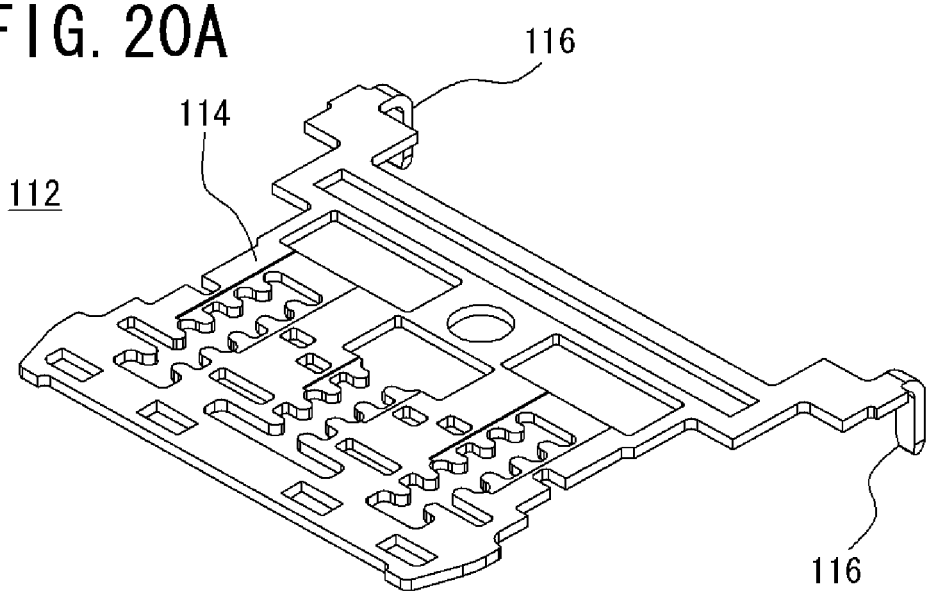
FIG. 20A shows a perspective view of a plate member according to the third embodiment of the present invention viewing from one side thereof.
Figure 20B:
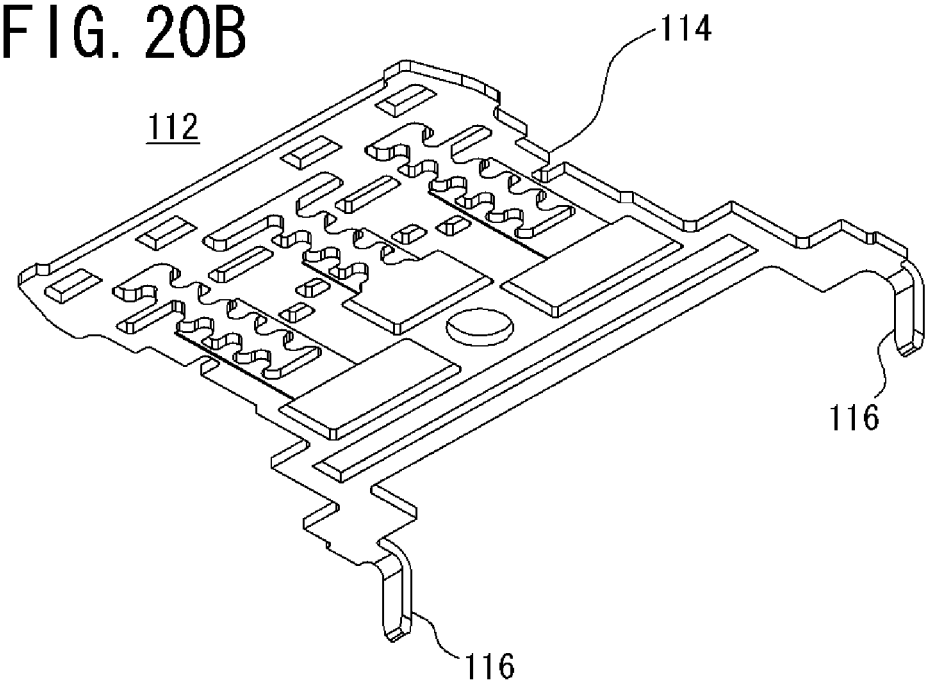
FIG. 20B shows another perspective view thereof viewing from another side thereof.

The plate member 112 provided in the second housing 94 has, as shown in FIGS. 20A and 20B, a base 114 which forms a base of the second housing 94 and reinforces the assembled-housing unit 68. The plate member 112 is formed by being punched out from a metal plate and thereafter being bent into a predetermined shape. The plate member 112 is formed with connecting members 116 for the plate member which are used as grounding members to be connected to the substrate.

Figure 21A:
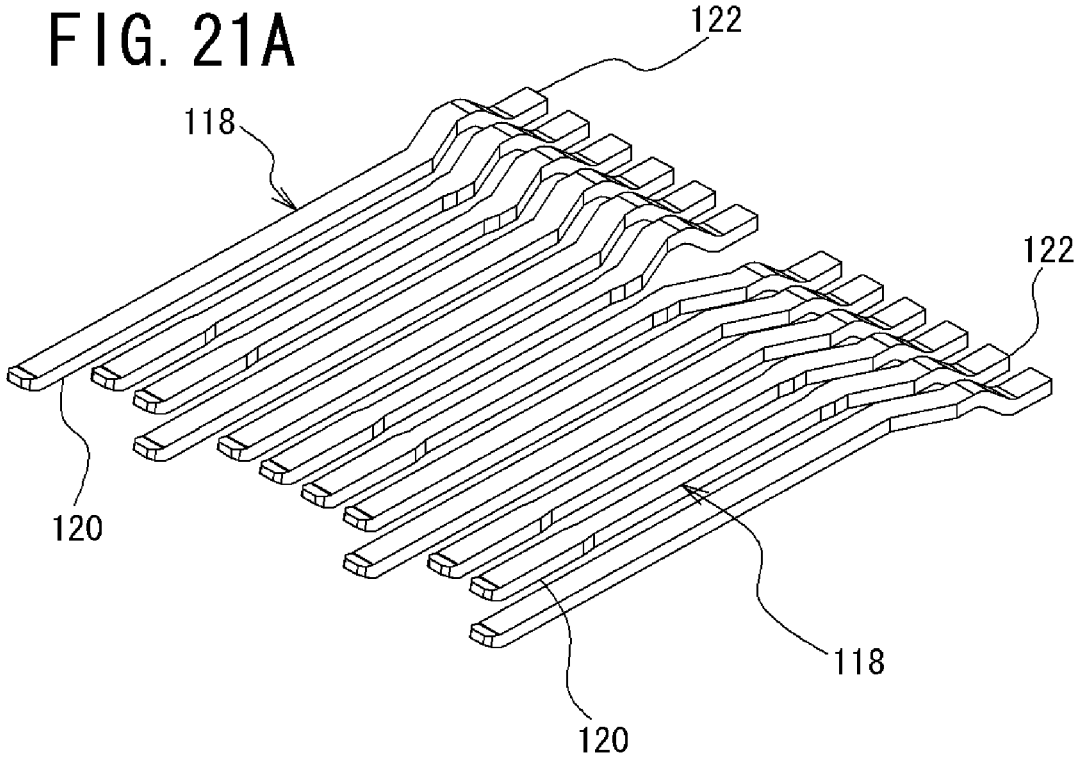
FIG. 21A shows second contacts according to the third embodiment of the present invention.
Figure 21B:
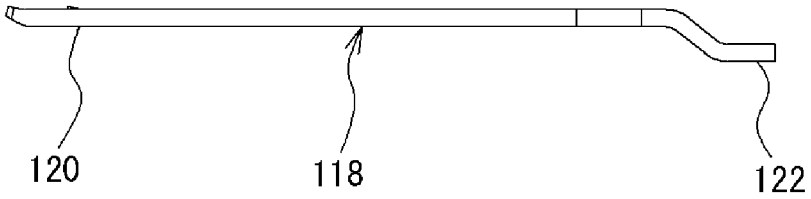
FIG. 21B shows a side elevational view thereof viewing from one side thereof.

The second contacts 118 are formed of metal rods each of which is formed into a predetermined shape and are placed side by side with predetermined intervals therebetween as shown in FIGS. 21A and 21B. One side of each second contact 118 is a second contact part 120 for contacting with a mating contact (not shown) of the counterpart connector while the other side thereof is a second connecting part 122 to be connected to the substrate by means of solder welding. Each second contact 118 is formed by being punched out from a metal plate and thereafter being bent into a predetermined shape.

The second housing 94 is, as shown in FIGS. 19A, 19B and 19C, formed into a block shape body having: a second front surface 96 which is formed in a manner to cover the second connecting part 122 side of each second contact 118; a second rear surface 98 which is opposite to the second front surface 96; a second upper surface 100 to be assembled with the first housing 70; a second bottom surface 102 which is opposite to the second upper surface 100, to which the second contact part 120 of each second contact 118 is mounted, and from which each second connecting part 122 is projected; a second side surface 104; and another second side surface 106.

The second front surface 96 of the second housing 94, which will be fitted into the counterpart connector, is formed into a flat planer shape, and is formed with tapers at both the second upper surface 100 side and the second bottom surface 102 side in order for easily fitting into the counterpart connector.

The second upper surface 100 of the second housing 94 is the surface to be assembled to the first housing 70 and is formed at the second front surface 96 side with a plurality of fitting slots 110 into which the first contacts 88 of the first housing 70 are fitted. These fitting slots 110 are formed in a manner to correspond to the position of the first contacts 88 of the first housing 70.

The second upper surface 100 is formed at the approximate center thereof with a plurality of second slots 108 which penetrate down to the second bottom surface 102, through which second slots 108 the second contacts 118 arranged on the second housing 94 and the plate member 112 are exposed to the outside. Each second slot 108 is the part to which the joining member 124 described later is assembled. The second slots 108 can be formed at any desirable places according to any technical requirements.

The second contact part 120 of each second contact 118 is arranged on the second front surface 96 side of the second bottom surface 102 of the second housing 94. The second bottom surface 102 is formed at the approximate center thereof with a plurality of second slots 108 which penetrate through the second housing 94 from the second upper surface 100 thereof.

The second contacts 118 are projected from the second bottom surface 102 at the second rear surface 98 thereof. Each projected-second connecting part 122 of the second contact 118 is bent toward the second rear surface 98 side.

A part of the plate member 112 which is incorporated in the second housing 94 is exposed to the outside at both the second front surface 96 side and the second rear surface 98 side of both second side surface 104 and the other second side surface 106. The connecting members 116 of the plate member 112 are exposed from the second rear surface 98 side.

Referring now to FIGS. 13A, 13B, 13C, 14, 15A, 15B, 16A and 16B, the joining member 124 will be described. The joining member 124 is formed into a cylindrical shape so that it covers one peripheral part of the first housing 70 and the second housing 94 which are assembled to each other.

The peripheral part 126 of the joining member 124 has a predetermined width and is formed into a cylindrical body which has approximately the same dimension as the internal surface of the shell 130. After the peripheral part 126 is inserted into the shell 130, the peripheral part 126 is closely fitted within the inner surface of the shell 130 and is integrally fixed thereto.

The joining member 124 is integrally formed as one member by assembling the first housing 70 and the second housing 94 together, thereafter arranging them in a metal mold for forming the joining member 124, then being molded with a resin material which forms the joining member 124.

In this process, the resin material forming the joining member 124 enters into gaps and spaces such as the hole 86 and the first slots 84 which are formed on the first housing 70, and the second slots 108 which is formed on the second housing 94. Thus, the first housing 70, the first contacts 88, the second housing 94, the second contacts 118, and the plate member 112 are integrally assembled to each other to form the housing unit 68 in the third embodiment.

The joining member 124 is formed into an annular shape so that the first housing 70 and the second housing 94 can protrude at the center thereof and in a manner to cover at least one part of the first upper surface 76 of the first housing 70, one part of the first contacts 88 at the first housing 70 side, one part of the first rear surface 74, one part of the first side surface 80, one part of the other first side surface 82, one part of the second bottom surface 102 of the second housing 94, one part of the second contacts 118 at the second rear surface 98 side of the second housing 94, one part of the second side surface 104, and one part of the other second side surface 106 when the joining member 124 is molded. The joining member 124 enters into a void formed at a part where the first bottom surface 78 of the first housing 70 and the second upper surface 100 of the second housing 94 are assembled together, thus the first housing 70 and the second housing 94 are fixed to each other.

The joining member 124 is formed at both lateral ends of each first housing 70 side and second housing 94 side with engagement parts 127 to which the cover members 172 described later are attached.

The joining member 124 in the third embodiment is formed of a different resin material from the one forming the first housing 70 and the second housing 94 in the same manner as in the first embodiment. More specifically, the joining member 124 is formed of a material which displays an adhesive capability when it is placed inside the shell 130 and is thereafter processed with heat. The material is, for example, polyester elastomer. It is preferable that the melting point of the material which forms the joining member 124 is lower than the melting point of the material which forms the first housing 70 and the second housing 94. The first housing 70 and the second housing 94 are formed of a material such as nylon and LCP (Liquid Crystal Polymer).

The cover members 172 for shielding noise such as electromagnetic waves are attached to a part of the joining member 124 where it covers the first contacts 88 assembled to the first housing 70 and the second contacts 118 assembled to the second housing 94 (refer FIGS. 13A, 13B, 13C and 14). The cover members 172 attached to the first housing 70 and the second housing 94 have the same configuration and are turned over against the other.

Figure 22A:
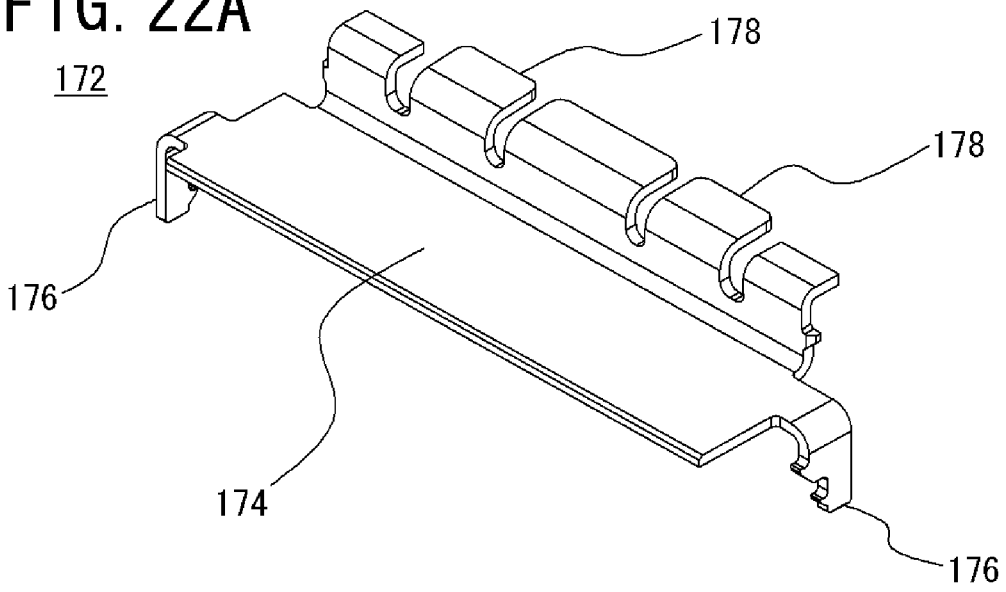
FIG. 22A shows a perspective view of a cover member according to the third embodiment of the present invention viewing from one side thereof.
Figure 22B:
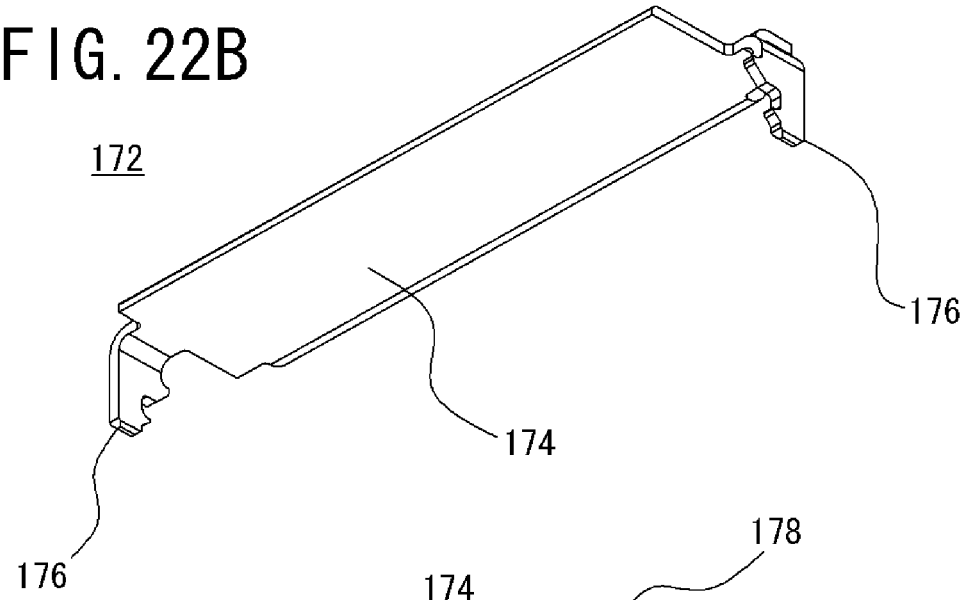
FIG. 22B shows another perspective view thereof viewing from another side thereof.
Figure 22C:
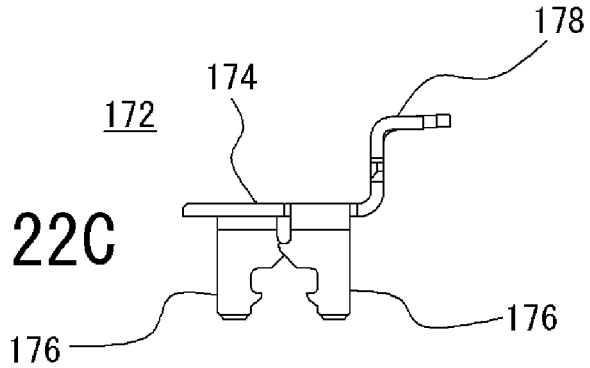
FIG. 22C shows a side elevational view thereof viewing from one side thereof.
Figure 23A:
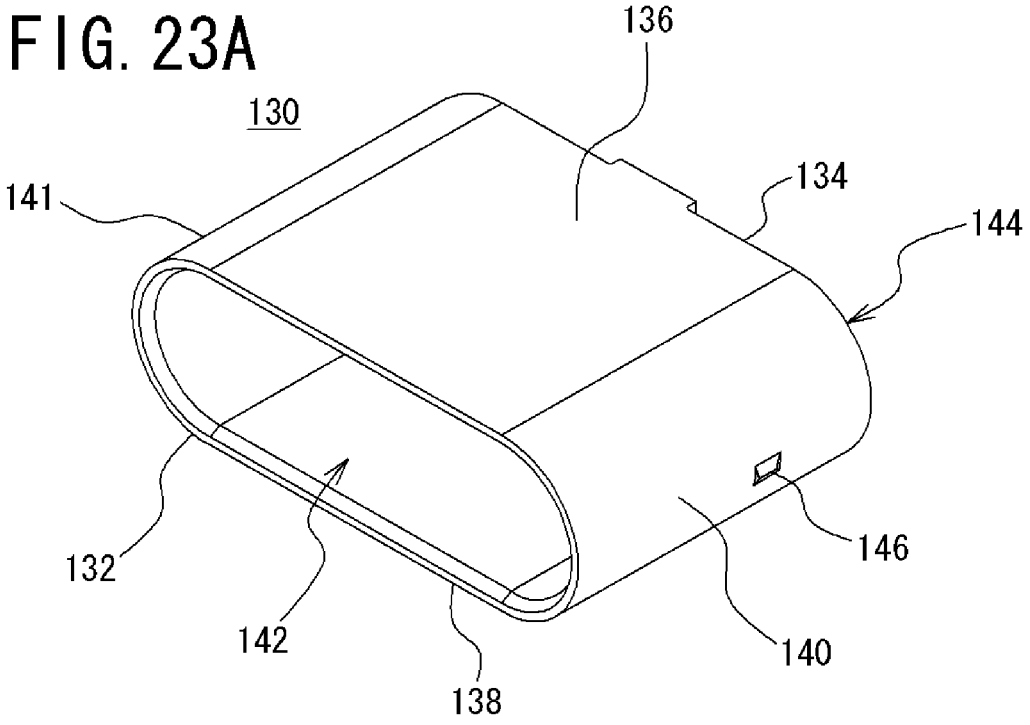
FIG. 23A shows a perspective view of a shell according to the third embodiment of the present invention viewing from one side thereof.
Figure 23B:
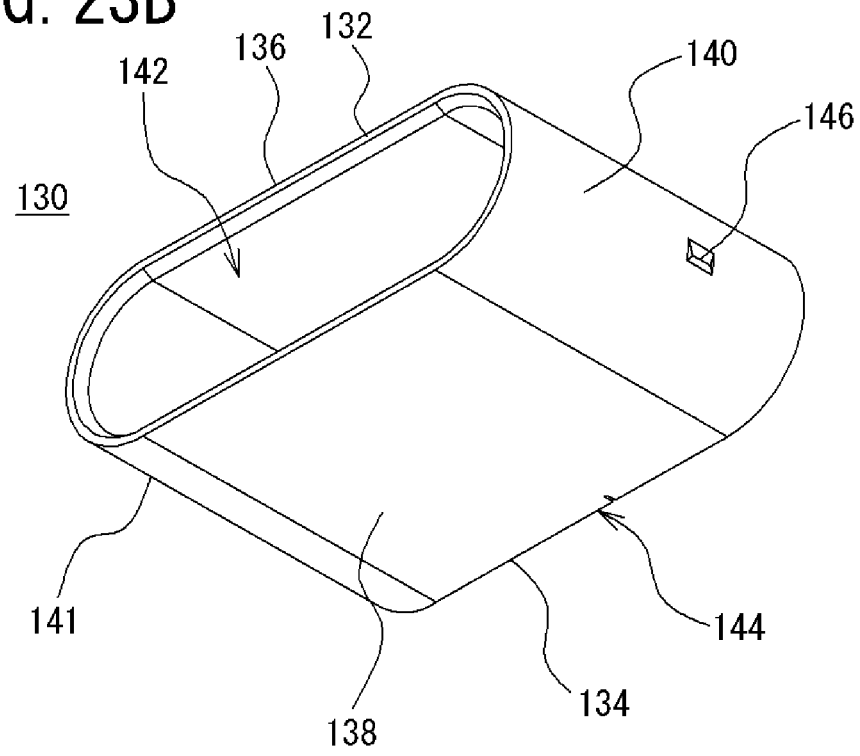
FIG. 23B shows another perspective view thereof viewing from another side thereof.
Figure 24A:
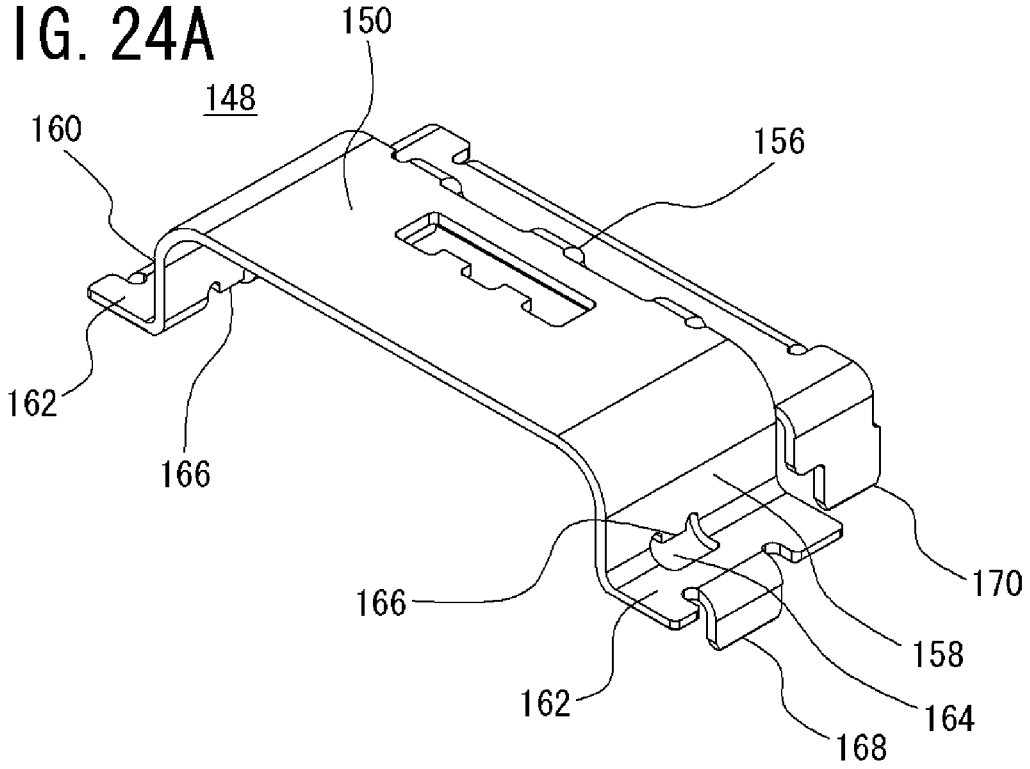
FIG. 24A shows a perspective view of a reinforcement member according to the third embodiment of the present invention viewing from one side thereof.
Figure 24B:
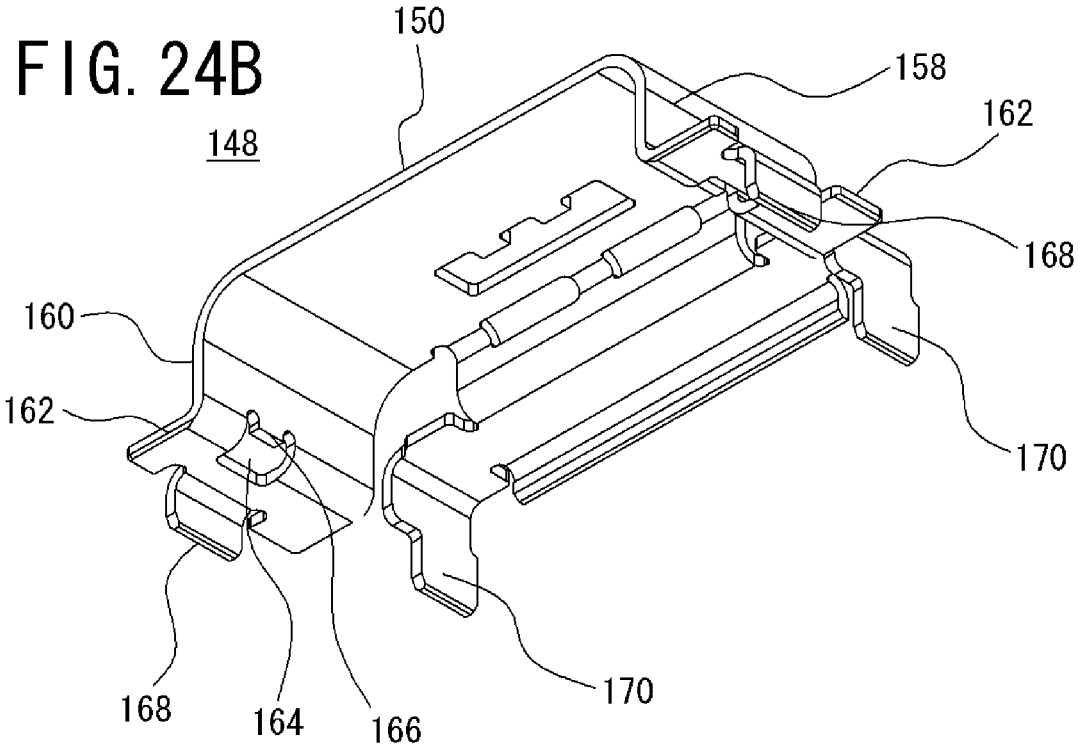
FIG. 24B shows another perspective view thereof viewing from another side thereof.

Each cover member 172 is formed into a C-shaped configuration as shown in FIGS. 22A, 22B and 22C, and includes a relatively large planer member 174 which is mounted onto the first upper surface 76 of the first housing 70 or onto the second bottom surface 102 of the second housing 94, and a pair of engagement lugs 176 which are bent at both lateral sides of the planer member 174 and are engaged with the joining member 124.

The engagement lugs 176 at both sides of each cover member 172 are formed symmetrically with each other and are inserted into the engagement parts 127 formed on the joining member 124 at both lateral sides of the first housing 70 side and at both lateral sides of the second housing 94 side, and are fixed thereto.

Each cover member 172 is formed with a plurality of L-shaped attachment lugs 178 extending from the planer member 174 at the place covering the first upper surface 76 side of the first housing 70 and the second bottom surface 102 side of the second housing 94. These attachment lugs 178 are engaged into attachment slots 128 formed on the joining member 124 at the first housing 70 side and the second housing 94 side (refer FIGS. 15A and 15B), thereby positioning the cover members 172 and the joining member 124. Each attachment lug 178 of the cover members 172 contacts with the inner surface of the metal shell 130.

Referring now to FIGS. 13A, 13B, 13C, 23A and 23B, the metal shell 130 will be described. The metal shell 130 has an opening 142 at one side into which the counterpart connector is inserted and an inserting port 144 at the other side from which the housing unit 68 is inserted thereinto during the assembling process of the connector 10B. The metal shell 130 is formed as a cylindrical body including a top plate 136 and a bottom plate 138 which are formed into planer shapes respectively, and a side plate 140 and the other side plate 141 and is formed by being punched out from a metal plate and bent.

The opening 142 is formed at a front part 132 of the metal shell 130 into which front part 132 the counterpart connector will be inserted. The inserting port 144 is formed at a back part 134 which is opposite to the opening 142, into which back part 134 the housing unit 68 will be inserted.

The side plate 140 and the other side plate 141 of the metal shell 130 are formed into a curved shape, respectively. The side plate 140 and the other side plate 141 are formed with bumps 146 in which parts of the side plate 140 and the other side plate 141 are protruded so that they will contact with the reinforcement member 148 which is described later.

The metal shell 130 is provided with an annular gasket 180 around the external peripheral side of the opening 142. The gasket 180 is formed of a resin material and is integrally formed with the metal shell 130 by a molding method.

Referring now to FIGS. 12A, 12B, 13A, 13B, 13C, 24A and 24B, the reinforcement member 148 will be described. The reinforcement member 148 is formed into a shape so that it covers the metal shell 130 when the connector 10B is assembled and is formed by being punched out from a metal plate and thereafter being bent. The reinforcement member 148 includes an upper part 150 for covering the top plate 136 of the metal shell 130, a side part 158 for covering the side plate 140 of the metal shell 130, another side part 160 for covering the other side plate 141 of the metal shell 130, and a back part 156 for covering the inserting port 144 of the metal shell 130. A bottom part side which is opposing to the upper part 150 and a front part which is opposing to the back part 156 are opened toward the lower side and the front side, respectively.

The upper part 150 of the reinforcement member 148 is formed into a planer plate shape whose dimension is to cover the top plate 136 of the metal shell 130. In the third embodiment, the upper part 150 has an opening at one part thereof.

The side part 158 and the other side part 160 of the reinforcement member 148 are formed so that they are downwardly bent at approximately right angle at both lateral ends of the upper part 150, respectively. In the third embodiment, the parts between the upper part 150 and the side part 158 and between the upper part 150 and the other side part 160 are formed into a curved shape, respectively.

In the third embodiment, the side part 158 and the other side plate 160 of the reinforcement member 148 are formed so that they cover the side plate 140 and the side plate 141 of the metal shell 130 down to the middle part thereof.

The reinforcement member 148 further has lead members 162 which are bent outward at approximately right angles from the ends of the side part 158 and the other side part 160 which ends are opposing to the upper part 150. These lead members 162 are fixed to the substrate by means of solder welding, thus the connector 10B is firmly fixed onto the substrate.

Each lead member 162 is formed with a fixing part 168 which is bent therefrom at approximately right angle toward the direction opposite to the upper part 150. The fixing part 168 is inserted into a slit formed on the substrate and is welded thereto by solder when the connector 10B is mounted onto the substrate, thus the connector 10B is more firmly fixed onto the substrate.

The bent portions between the side part 158 and the lead member 162 and between the other side part 160 and the lead member 162 are formed with openings 164 each of which opening 164 is formed with protrusion 166. This protrusion 166 will contact with the bump 146 formed on the metal shell 130. The protrusion 166 also can be fixed to the bump 146 of the metal shell 130 by means of welding.

The reinforcement member 148 is formed at its back part 156 with plate members which are extended and bent downward from the back end of the back part 156 of the upper part 150 and the plate members are formed in a manner to have a step along the shape of the first upper surface 76 of the first housing 70 of the housing unit 68. The step extending from the back part 156 of the reinforcement member 148 is formed at both lateral ends of the parallel section being parallel to the upper part 150 corresponding to the side part 158 side and the other side part 160 side with back fixing parts 170 which are bent downwardly. The back fixing parts 170 will be inserted into the substrate and are welded thereto by solder.

An assembling method (manufacturing method) of the connector 10B in the third embodiment will be explained hereinafter. In order to assemble the connector 10B in the third embodiment, first of all, the housing unit 68 is assembled. The assembling of the housing unit 68 is carried out, as shown in FIGS. 15A, 15B, 16A and 16B, by mating the first housing 70 into which the first contacts 88 are integrally incorporated (refer FIGS. 17A, 17B and 17C) with the second housing 94 into which the second contacts 118 and the plate member 112 are integrally incorporated (refer FIGS. 19A, 19B and 19C) together, thereafter arranging them in a metal mold for forming the joining member 124, then being molded with a resin material which forms the joining member 124, thus the first housing 70, the second housing 94, and the joining member 124 are integrally assembled together. During this assembling process, the first contact part 90 of each first contact 88 incorporated into the first housing 70 is fitted into the corresponding fitting slot 110 formed on the second upper surface 100 of the second housing 94.

During the molding process of the joining member 124, the outline of the joining member 124 is formed so that the peripheral part 126 has a dimension which can closely fit within the metal shell 130. Further in this process, the resin material forming the joining member 124 enters into the interior space between the first housing 70 and the second housing 94, and is closely adheres to the first housing 70, the first contacts 88, the second housing 94, the second contacts 118, and the plate member 112, thus the first housing 70 and the second housing 94 form one integral unit. In this process, the resin material enters into gaps and spaces such as the hole 86 and the first slots 84 which are formed on the first housing 70, and the second slots 108 which is formed on the second housing 94. Thus, the first housing 70 and the second housing 94 can be more firmly stuck together.

Figure 13A:
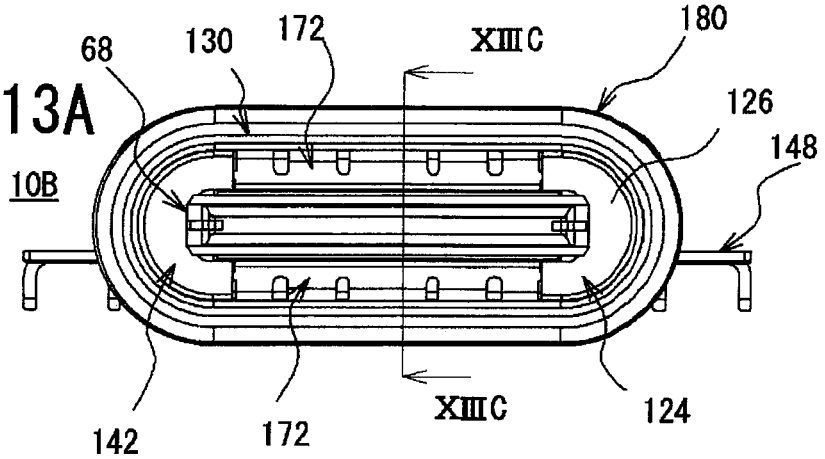
FIG. 13A shows a front elevational view of the connector according to the third embodiment of the present invention.
Figure 13B:
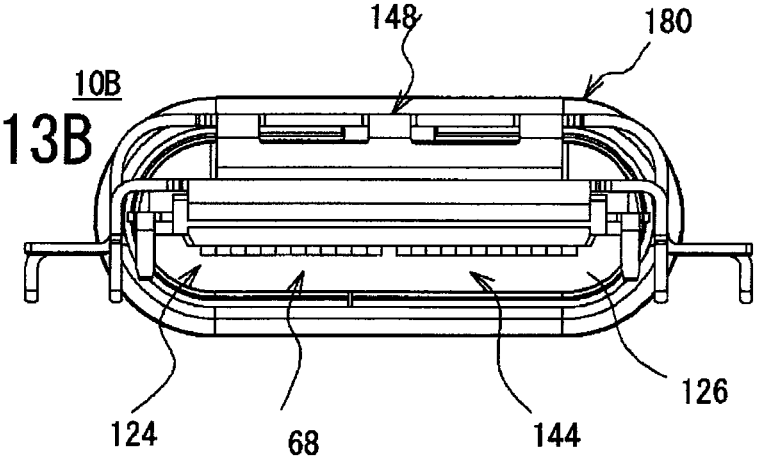
FIG. 13B shows a rear elevational view thereof.
Figure 13C:
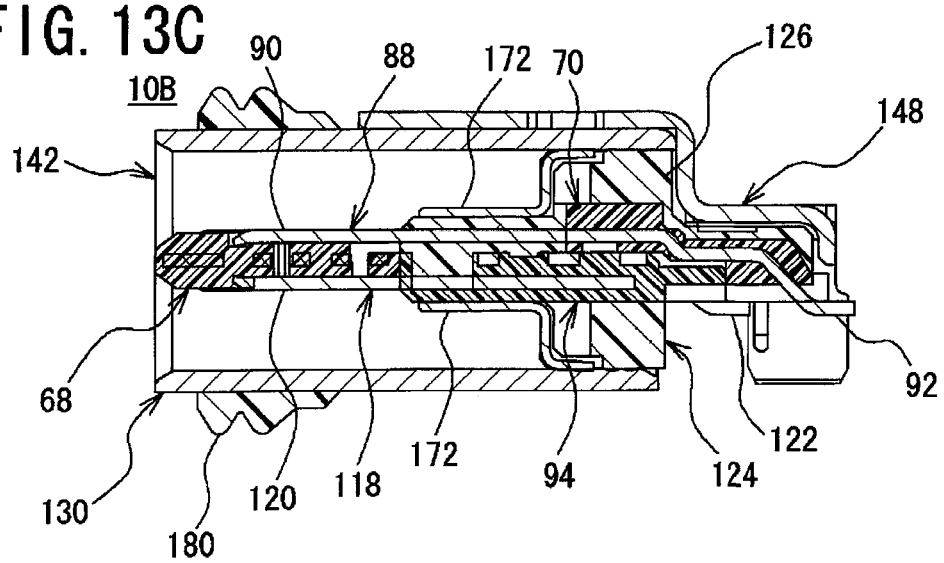
FIG. 13C shows a cross-sectional view at XIIIC-XIIIC line in FIG. 13A.
Figure 14:
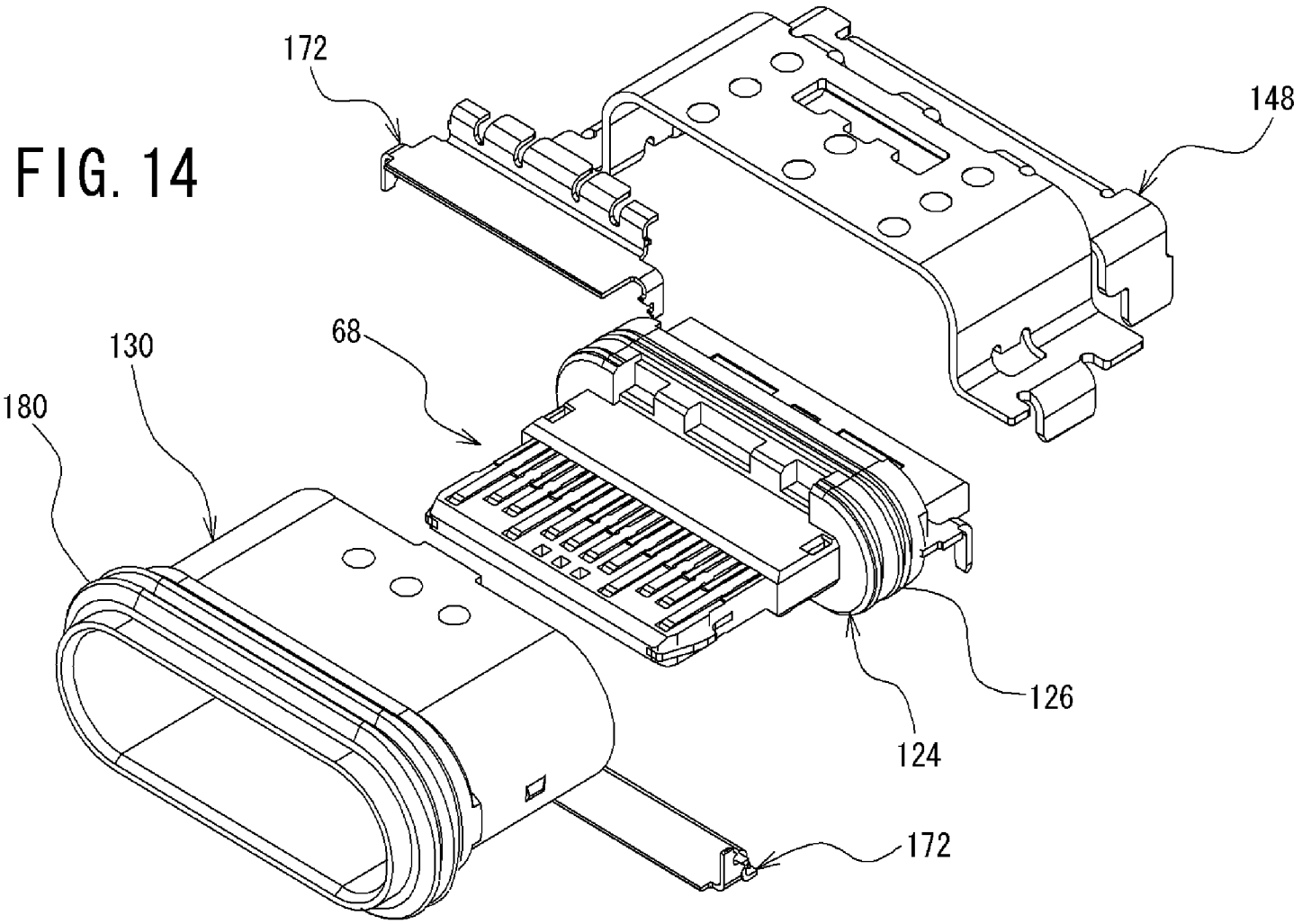
FIG. 14 shows an exploded perspective view of the connector according to the third embodiment of the present invention.
Figure 15A:
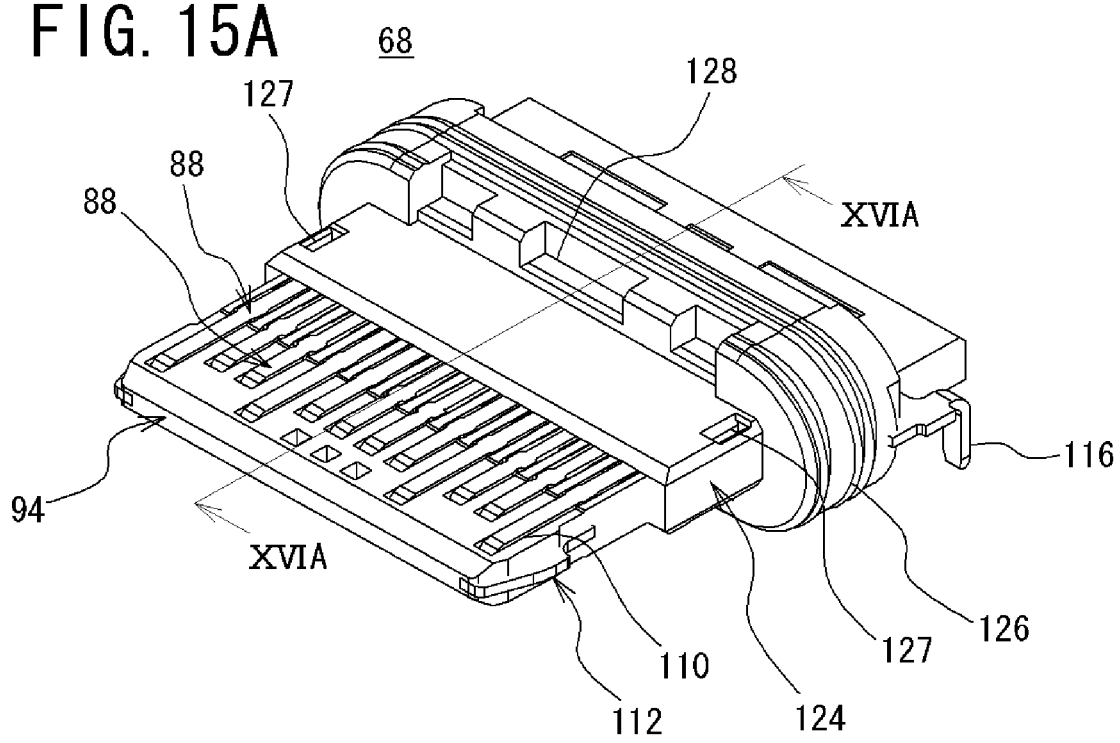
FIG. 15A shows a perspective view of a housing unit according to the third embodiment of the present invention viewing form one side thereof.
Figure 15B:
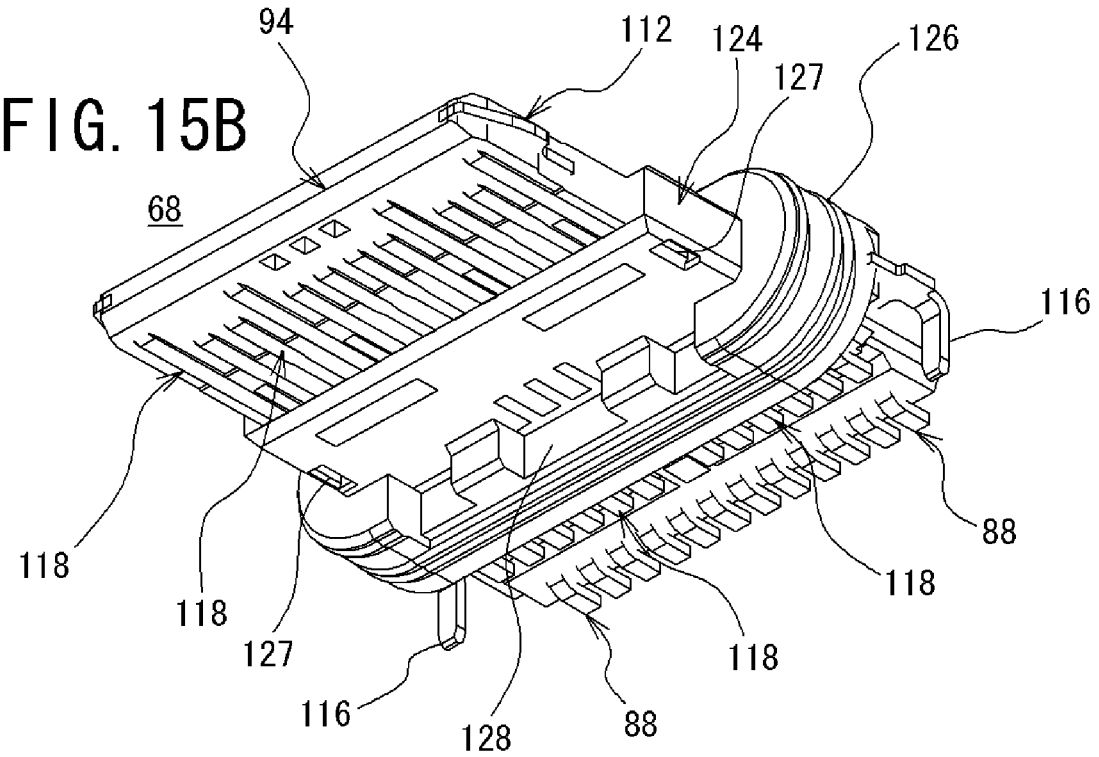
FIG. 15B shows another perspective view thereof viewing from another side thereof.
Figure 16A:
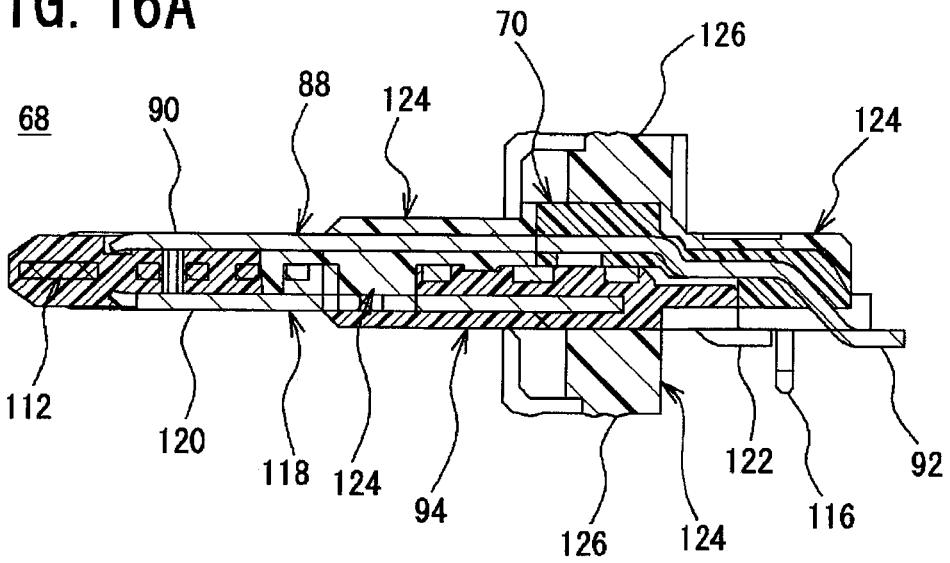
FIG. 16A shows a cross-sectional view at XVIA-XVIA line in FIG. 15A.
Figure 16B:
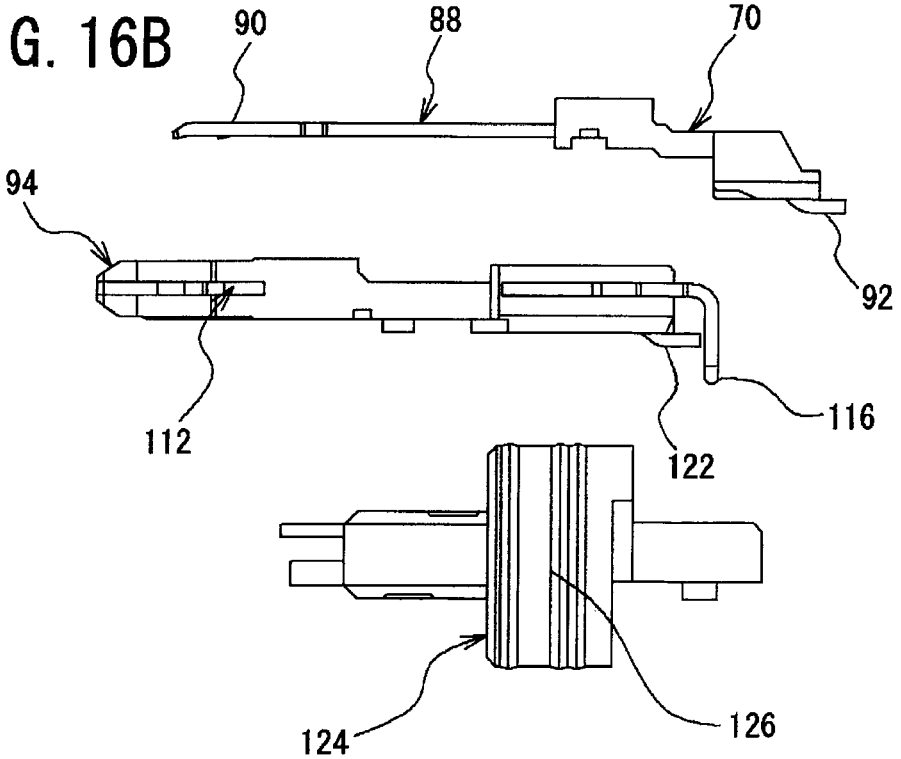
FIG. 16B shows an exploded side elevational view thereof viewing from one side thereof.

Thereafter, the cover members 172 are attached to the assembled housing unit 68 around the first housing 70 side of the joining member 124 and the second housing 94 side of the joining member 124, respectively (refer FIGS. 13B and 14). This is achieved by inserting each engagement lug 176 of the cover members 172 into each engagement part 127 which is formed on the joining member 124, and by engaging each attachment lug 178 which is formed on the cover members 172 with each attachment slot 128 which is formed on the joining member 124.

Then, the housing unit 68 to which the cover members 172 are attached is placed inside the metal shell 130. This is achieved by inserting the housing unit 68 into the metal shell 130 from the inserting port 144 side thereof, and placing the peripheral part 126 of the housing unit 68 at the predetermined position inside the metal shell 130. In this moment, the peripheral part 126 of the joining member 124 of the housing unit 68 comes to be closely fitted within the inner surface of the metal shell 130 without any space therebetween. The attachment lugs 178 of each cover member 172 attached to the housing unit 68 come to contact with the inner surface of the metal shell 130.

Thereafter, the housing unit 12 being kept within the shell is thermally treated in a high temperature oven. By this thermal process, as the same with the first embodiment, the joining member 124 is softened and adhered to the internal surface of the metal shell 130. As the temperature decreases, the joining member 124 is hardened and fixed to the metal shell 130, and they are integrally fixed to each other. The temperature of the thermal process should be lower than the melting point of the resin material forming the first housing 70 and the second housing 94 and be the same as or slightly lower than the melting point of the resin material forming the joining member 124 in which temperature the resin material of the joining member 124 can be softened.

Thereafter, the reinforcement member 148 and the gasket 180 are attached around the outer periphery of the metal shell 130 (refer FIGS. 13B and 14). The attachment of the reinforcement member 148 to the reinforcement member 148 is carried out by, for example, a welding method. The gasket 180 is integrally formed around the outer periphery of the metal shell 130 by a molding method. The connector 10B in the third embodiment is thus assembled.

The connector 10B in the third embodiment, by employing the above constitution, can have a water proof capability of the joining member 124 without a need of a sealing member such as an O-ring, thus the manufacturing cost thereof and the assembling steps thereof can be decreased. Further, the connector can be miniaturized since there is no need for extra configuration to fix the housing unit to the metal shell.

Since the joining member 124 is softened and adhered to the inner surface of the metal shell 130 during the thermal process, thus the joining member 124 can be attached without any space therebetween to the shell regardless whether the inner surface of the shell is smooth surface or not.

In the connector 10B of the above third embodiment, it is described that the joining member 124 is formed of a material which provides adhesiveness when it is heat-treated. However, the present invention is not limited to the above. The joining member 124 can also be formed of a material which provides adhesiveness when it is integrally formed with the housing by molding process such as thermoplastic polyester resin. In this way, since the joining member 124 can provide adhesiveness against the shell when the joining member 124 is placed inside the shell. This can provide a water proof capability. Therefore, the use of sealing members such as an O-ring can be omitted.

In the above third embodiment, the reinforcement member 148 and the gasket 180 are attached to the metal shell 130 and the housing unit 68 after the housing unit 68 is heat-treated. However, the present invention is not limited to the above method. The reinforcement member 148 and the gasket 180 can also be attached thereto previous to the heat treatment thereof.

In the above third embodiment, it is described that the gasket 180 is integrally formed with the metal shell 130. However, the present invention is not limited the above embodiment. The gasket can be separately formed and be lately attached to the metal shell 130.

What is claimed is:

1. A connector, comprising:

at least one contact;

a housing to which the contact is arranged;

a shell formed into a cylindrical shape inside of which the housing is directly disposed; and a joining member formed of resin material and having substantially the same outer shape with an outer shape of the housing, wherein the housing and the contact form an integral unit by means of the joining member, and wherein the joining member has a predetermined shape that can be inserted into the shell and is substantially water proof fitted, in its entirety, within an inner surface of the shell, wherein the joining member, which has the predetermined shape and is made of resin material, provides waterproofing inside the shell.

2. The connector according to claim 1, wherein the joining member is fixed to the inner surface of the shell so that the joining member and the shell form an integral unit.

3. The connector according to claim 1, wherein the housing is formed of a resin material, and the housing and the contact are formed so that the housing and the contact form an integral unit.

4. The connector according to claim 1, wherein the housing includes at least two partial members being assembled together, and wherein the partial members form an integral unit by means of the joining member.

5. The connector according to claim 1, wherein the resin material which forms the joining member has adhesiveness when the resin material is heat treated.

6. The connector according to claim 5, wherein the joining member is formed of a resin material which melting point is different from the melting point of a resin material which forms the housing, and wherein the melting point of the resin material which forms the joining member is lower than the melting point of the resin material which forms the housing.

* * * * *